US012426662B2

(12) United States Patent
Pahlmeyer et al.

(10) Patent No.: US 12,426,662 B2
(45) Date of Patent: Sep. 30, 2025

(54) FACEMASK SYSTEM

(71) Applicant: VICIS IP, LLC, New York, NY (US)

(72) Inventors: Marie Pahlmeyer, Seattle, WA (US); Travis E. Glover, Seattle, WA (US); Jason Neubauer, Seattle, WA (US); Kurt V. Fischer, Seattle, WA (US); Noah Lanphear, Seattle, WA (US); Andre Stone, Seattle, WA (US); Adam Kollgaard, Seattle, WA (US); Kayla Fukuda, Seattle, WA (US); Derek Wallin, Seattle, WA (US); Cord Santiago, Seattle, WA (US)

(73) Assignee: VICIS IP, LLC, New York, NY (US)

( * ) Notice: Subject to any disclaimer, the term of this patent is extended or adjusted under 35 U.S.C. 154(b) by 0 days.

(21) Appl. No.: 18/426,177

(22) Filed: Jan. 29, 2024

(65) Prior Publication Data

US 2024/0164468 A1 May 23, 2024

Related U.S. Application Data

(63) Continuation of application No. 17/140,598, filed on Jan. 4, 2021, now Pat. No. 11,918,070.
(Continued)

(51) Int. Cl.
*A42B 3/20* (2006.01)
*A63B 102/14* (2015.01)
(Continued)

(52) U.S. Cl.
CPC ..... *A42B 3/20* (2013.01); *A63B 2102/14* (2015.10); *A63B 2102/18* (2015.10);
(Continued)

(58) Field of Classification Search
CPC ..... A42B 3/20; A42B 3/205; A63B 2102/24
See application file for complete search history.

(56) References Cited

U.S. PATENT DOCUMENTS 3,729,746 A * 5/1973 Humphrey ..... A42B 3/20 2/9
4,999,856 A 3/1991 DuVall
(Continued)

FOREIGN PATENT DOCUMENTS

EP 1941807 A1 * 7/2008 ..... A42B 3/20
WO WO-2020092629 A1 * 5/2020 ..... A42B 3/00

*Primary Examiner* — Tajash D Patel
(74) *Attorney, Agent, or Firm* — Ingrassia Fisher & Lorenz, LLP

(57) ABSTRACT

The invention relates to a system and/or an apparatus for an improved helmet system that may help reduce the severity of injuries by enhancing overall helmet protection through uniquely designed facemasks and facemask bumpers. The facemask and facemask bumpers that are particularly adapted to redistribute pressure and impact forces, decrease vibration, sudden shock, noise and/or the peak forces transmitted from the facemask to the rest of the helmet system. The facemask bumpers may be disposed into specific regions of the facemask, including the brow region, the glabella region, orbit region, the frontal region, the mandible (front, right and/or left side) region, the maxilla region, the nasal region, zygomatic region, the ethmoid region, the lacrimal region, the sphenoid region and/or any combination thereof.

18 Claims, 20 Drawing Sheets

Related U.S. Application Data

(60) Provisional application No. 62/956,768, filed on Jan. 3, 2020.

(51) Int. Cl.
*A63B 102/18* (2015.01)
*A63B 102/22* (2015.01)
*A63B 102/24* (2015.01)

(52) U.S. Cl.
CPC ..... *A63B 2102/22* (2015.10); *A63B 2102/24* (2015.10); *A63B 2243/007* (2013.01)

(56) References Cited

U.S. PATENT DOCUMENTS

| | | | | |
|---|---|---|---|---|
| D461,152 | S | 8/2002 | Schmitt | |
| 6,871,525 | B2 | 3/2005 | Withnall et al. | |
| D587,852 | S | 3/2009 | Nimmons | |
| D590,106 | S | 4/2009 | Nimmons | |
| D598,610 | S | 8/2009 | Soukup et al. | |
| 7,975,319 | B2 | 7/2011 | Moore | |
| 8,528,118 | B2 | 9/2013 | Ide et al. | |
| D704,899 | S | 5/2014 | Erb et al. | |
| D718,002 | S | 11/2014 | Littrell | |
| D748,346 | S | 1/2016 | Erb et al. | |
| D752,822 | S | 3/2016 | Bologna | |
| D758,669 | S | 6/2016 | Collette et al. | |
| D764,116 | S | 8/2016 | Collette et al. | |
| D767,211 | S | 9/2016 | Lamson | |
| D772,489 | S | 11/2016 | Lamson | |
| D787,748 | S | 5/2017 | Bologna | |
| 9,743,702 | B2 | 8/2017 | Warmouth | |
| 9,750,298 | B2 | 9/2017 | Summerville | |
| 9,788,591 | B2 | 10/2017 | Ide et al. | |
| 10,092,054 | B2 | 10/2018 | Williams | |
| 10,136,692 | B2 | 11/2018 | Ide et al. | |
| 10,159,296 | B2 | 12/2018 | Pietrzak et al. | |
| 10,201,743 | B1 | 2/2019 | Simpson | |
| D844,255 | S | 3/2019 | Bologna | |
| 10,271,605 | B2 | 4/2019 | Withnall et al. | |
| 10,315,095 | B1 | 6/2019 | Sneed | |
| 10,362,829 | B2 | 7/2019 | Lowe | |
| D856,600 | S | 8/2019 | Withnall et al. | |
| 10,506,841 | B2 | 12/2019 | Bologna et al. | |
| 10,561,193 | B2 | 2/2020 | Withnall et al. | |
| 10,780,338 | B1 | 9/2020 | Bologna et al. | |
| 10,856,600 | B2 | 12/2020 | Ide et al. | |
| 10,905,936 | B2 | 2/2021 | Tryner et al. | |
| 10,932,514 | B2 | 3/2021 | Ide et al. | |
| 10,948,898 | B1 | 3/2021 | Pietrzak et al. | |
| D916,385 | S | 4/2021 | Withnall et al. | |
| D927,084 | S | 8/2021 | Bologna et al. | |
| D932,108 | S | 9/2021 | Pahlmeyer | |
| 11,166,511 | B2 | 11/2021 | Infusing et al. | |
| 11,167,198 | B2 | 11/2021 | Bologna et al. | |
| 11,172,723 | B2 | 11/2021 | Summerville | |
| 11,213,736 | B2 | 1/2022 | Bologna et al. | |
| 11,291,263 | B2 | 4/2022 | Lowe | |
| 11,311,067 | B2 | 4/2022 | Bologna et al. | |
| D958,464 | S | 7/2022 | Pahlmeyer et al. | |
| 11,399,589 | B2 | 8/2022 | Bologna et al. | |
| 11,419,383 | B2 | 8/2022 | Pietrzak et al. | |
| 11,503,872 | B2 | 11/2022 | Bologna et al. | |
| 11,638,457 | B2 | 5/2023 | Lowe | |
| 11,712,615 | B2 | 8/2023 | Bologna et al. | |
| 2007/0151003 | A1* | 7/2007 | Shih | A42B 3/20 2/424 |
| 2009/0126063 | A1 | 5/2009 | Brown et al. | |
| 2011/0271428 | A1* | 11/2011 | Withnall | A42B 3/20 2/422 |
| 2014/0223643 | A1 | 8/2014 | Infusino et al. | |
| 2014/0223644 | A1 | 8/2014 | Bologna et al. | |
| 2014/0223646 | A1 | 8/2014 | Bologna et al. | |
| 2014/0325744 | A1* | 11/2014 | Klein | A42B 3/20 267/136 |
| 2017/0056752 | A1* | 3/2017 | Tubbs | A42B 3/20 |
| 2020/0046058 | A1 | 2/2020 | Santiago | |
| 2021/0161241 | A1 | 6/2021 | Klein | |
| 2022/0031003 | A1 | 2/2022 | Summerville | |
| 2022/0061448 | A1 | 3/2022 | Withnall et al. | |

* cited by examiner

FACEMASK SYSTEM

CROSS-REFERENCE TO RELATED APPLICATIONS

This application is a continuation of U.S. patent application Ser. No. 17/140,598, filed Jan. 4, 2021, which claims the benefit of U.S. provisional patent application No. 62/956,768, filed Jan. 3, 2020. The disclosures of the listed applications are incorporated by reference herein.

TECHNICAL FIELD

The invention relates to a system and/or an apparatus for an improved helmet system that may help reduce the severity of injuries by increasing overall helmet protection. More specifically, the improved helmet system includes an enhanced facemask and facemask impact bumpers that are particularly adapted to redistribute pressure and impact forces, decrease the peak transmitted forces from the facemask to the rest of the helmet system, decrease vibration, sudden shock, and/or noise.

BACKGROUND

Medical research reveals that concussions and cumulative head impacts can lead to lifelong neurological consequences. It is currently believed that repeated brain injuries, such as concussions, may lead to diseases later in life, such as depression, chronic traumatic encephalopathy (CTE), and amyotrophic lateral sclerosis (ALS) and early Alzheimer's. The U.S. Center for Disease Control and Prevention estimates 1.6-3.8 million sport-related brain injuries annually in the United States. Of these 300,000 are attributed to youth football players, some of whom die from their injuries every year— a tragedy difficult for their parents and families to recover from. The severity of the issue touching both the nation's youth and professional athletes has led to thousands of lawsuits and Congressional Hearings.

Due to the observed and high potential of brain injuries, there has been significant modifications in helmet designs focusing on enhancing the impact mitigation layer. Unfortunately, the facemasks have been overlooked by the head impact research community and manufacturers. Yet despite advances in impact mitigation layer technology, the facemask structural and/or material properties should be investigated to improve the overall impact absorption of the helmet. Manufacturer's and the impact research community fail to recognize the importance of the facemask and its ability to transfer the g-forces, pressures and/or vibration directly to the helmet upon a significant impact. Further improvements in facemask design are required to facilitate dampening of the g-forces, pressures and/or vibration to the helmet after impact.

BRIEF SUMMARY

Accordingly, a new helmet system and an improved facemask with an enhanced structural design are provided. Such improved facemask design may have a modified structural feature that comprises an upper portion with a raised eyebrow area that helps mitigate and/or lessen the distribution of pressure or force of impact that the facemask may transmit to the helmet, and ultimately to the player's head. In addition, the improved facemask may further comprise one or more impact mitigation bumpers that may significantly mitigate and/or lessen the peak pressure or peak force of impact that the facemask may transmit to the helmet, as well as reduce noise and/or vibration propagation. Accordingly, the unique facemask design and the impact mitigation bumpers, by themselves or combined, may reduce the total energy transferred to the wearer's head and/or properly distribute pressure over a larger area to potentially reduce the concussions and/or brain injuries.

In one exemplary embodiment, the new helmet system may comprise an improved facemask. The improved facemask may be retrofitted into commercially available helmets and/or be incorporated within manufacturer's own helmet. The improved facemask having an upper portion and a lower portion, the upper portion including a top bar and a lower bar, the top bar having a first arched section, a second arched section, and a central section, the first and second arched section is bent upwardly away from the top bar central section creating a distance, the distance being less than a multiple of the diameter of the top bar central section, at least a portion of the top bar central section being coupled to at least a portion of the lower bar through at least one horizontal member, the at least one horizontal member having a width and a height, the width is greater than the height, and/or the horizontal member having the width greater than the top bar and/or lower bar. A portion of the top portion lower bar extends beyond a portion of the top portion top bar, the portion of the lower bar contacts the portion of the top bar. The lower portion may comprise at least one top bar and at least one bottom bar, and one or more vertical bars. The improved facemask may further comprise a central portion. The central portion having at least one eye bar, the at least one eye bar extending longitudinally between the top portion and the bottom portion.

In another exemplary embodiment, the new helmet system may comprise one or more impact mitigation bumpers. The one or more impact mitigation bumpers may be retrofitted into commercially-available facemasks and/or be incorporated within manufacturer's own facemask design. Each of the one or more impact mitigation bumpers may comprise a single unitary piece. The single unitary piece may comprise a first portion, an impact mitigation structure, and/or a second portion, the impact mitigation structure disposed between the first portion and the second portion. Each of the first portion, the impact mitigation structure, and/or the second portion may comprise the same material and/or different materials. Alternatively, the one or more impact mitigation bumpers may comprise multi-unit pieces that are coupled together to create the usable bumper. The multi-unit bumper may comprise a first portion, an impact mitigation structure, and/or a second portion, the impact mitigation structure disposed between the first portion and the second portion. Each of the first portion, the impact mitigation structure, and/or the second portion may comprise the same material and/or different materials. The impact mitigation structure is coupled to the first and second portion. Coupling may be methods and/or mechanical structures known in the art.

In another exemplary embodiment, the new helmet system may comprise a helmet and an improved facemask. The helmet may comprise an outer layer. The helmet may further comprise an impact mitigation layer and/or an inner layer, the impact mitigation layer may be disposed between the outer layer and the inner layer. The helmet having a front portion and a back portion. The facemask being removably connected to the front portion of the helmet, the facemask having an upper portion and a lower portion. The upper portion including a lower bar, a first arched section, a second arched section, and a central section, the first and second arched section is bent upwardly away from the lower bar central section creating a distance, the distance being less than a multiple of the diameter of the lower bar central section.

In another exemplary embodiment, the new helmet system may comprise a helmet, a facemask, and/or one or more impact mitigation bumpers. The helmet may comprise an outer layer. The helmet may further comprise an impact mitigation layer and/or an inner layer, the impact mitigation layer may be disposed between the outer layer and the inner layer. The helmet having a front portion and a back portion. The facemask being removably connected to the helmet. The facemask may be a traditional facemask, and/or the improved facemask described herein. The one or more bumpers being coupled to the facemask and/or the helmet. The single unitary piece may comprise an upper portion, an impact mitigation structure, and/or a lower portion, the impact mitigation structure disposed between the upper portion and the lower portion. Each of the upper portion, the impact mitigation structure, and/or the lower portion may comprise the same material and/or different materials. Alternatively, the one or more impact mitigation bumpers may comprise multi-unit pieces that are coupled together to create the usable bumper. The multi-unit bumper may comprise an upper portion, an impact mitigation structure, and/or a lower portion, the impact mitigation structure disposed between the upper portion and the lower portion. Each of the upper portion, the impact mitigation structure, and/or the lower portion may comprise the same material and/or different materials. The impact mitigation structure is coupled to the upper and lower portion. Coupling may be methods and/or mechanical structures known in the art.

DETAILED DESCRIPTION

Figure 1:
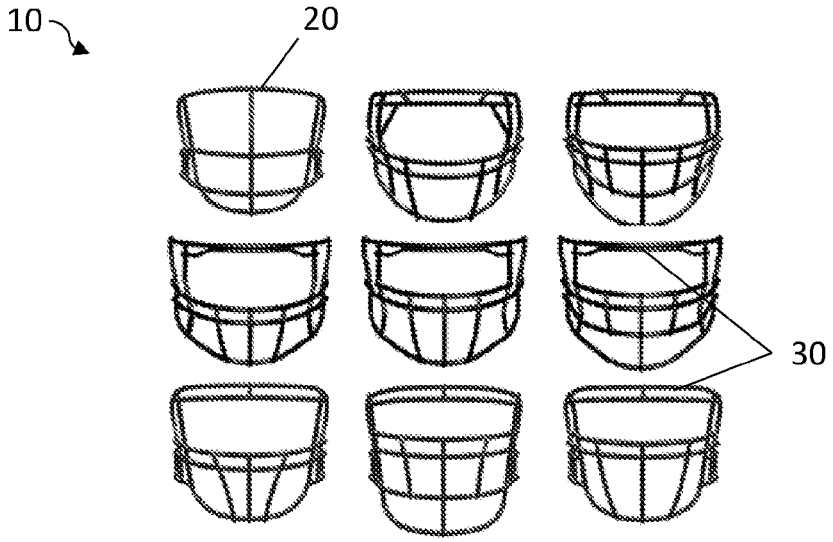
FIG. 1 (PRIOR ART)
FIG. 1 depicts front views of various prior art facemask designs.

Traditional sport helmets may comprise a helmet and a facemask. The traditional facemask is usually coupled to the front portion of the helmet. The facemask may have a plurality of bars that form a wire cage that protects the wearer from impacts yet allows visibility at the same time. Traditional facemasks 10 may comprise an upper portion and a lower portion, where the upper portion may include various numbers, orientations and/or arrangements of support bars, including one-bar 20 or two-bar 30 support systems, such as shown in FIG. 1. Each of these one-bar 20 and/or two-bar 30 support systems were desirably designed such that the horizontal support bars were arranged in a continuous and/or substantially continuous shape that followed the contours of the curved front edge (i.e., the face opening) of the helmet, to potentially prevent collapse of the facemask under impact. In many cases, the facemask design and its intended attachment to the helmet transmits impact forces directly to the helmet and/or fails to distribute the pressures, which lead to higher peak forces and higher localized stress concentrations on the helmet material and the wearer.

Figure 2A:
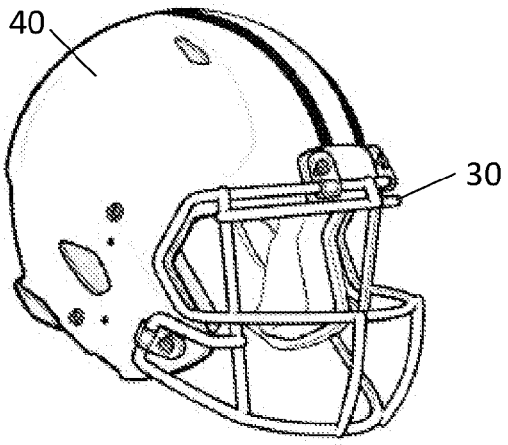
FIG. 2A (PRIOR ART)
FIGS. 2A-2B depict isometric and isometric magnified views of the distribution of localized forces for a prior art facemask design.
Figure 2B:
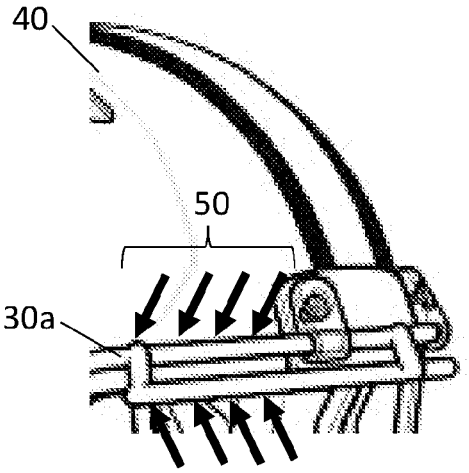
FIG. 2B (PRIOR ART)

FIG. 2A depicts an exemplary helmet 40 with a traditional two-bar 30 variation facemask, with FIG. 2A depicting a magnified view of the dual upper bars 30 positioned against a portion of the helmet proximate to a face opening of the helmet 40. In this arrangement, the placement and rigidity of the facemask "cage" causes impact forces 50 acting inward on the facemask to be concentrated and transmitted directly to a relatively small region of the helmet 40 and/or a region proximate to the impact (see FIG. 2B). For example, when an impact to the front and/or upper section of the facemask occurs, a significant concentration of pressure (i.e., P=Force/Area) is transferred to a highly localized area of the facemask, resulting in significant forces being immediately transmitted directly the wearer's forehead and greatly increasing injury to the wearer. Moreover, this transmitted force occurs over a short period, which means that the reactive acceleration imparted to the wearer further increases the risk of a concussion, other brain injury and/or a potential neck injury to the wearer.

Aside from this potential increase in pressure on the wearer's forehead, the force due to an impact on the facemask will not be distributed or dissipated appropriately because of the concentration of forces in this area. Accordingly, a facemask experiencing tangential and/or rotational impact forces are similarly not well distributed and/or dissipated by the traditional facemask design, mainly due to the placement and fixation methods of the facemask to the helmet. In many cases, these traditional facemask designs can cause the rotational impact forces to be transmitted directly to the helmet and/or wearer's head, and can be associated with an increased acceleration of the helmet/head combination, potentially leading to broken bones, significant bruising, concussion, traumatic brain injuries and/or any combination thereof.

Furthermore, traditional helmets and facemasks may not allow dampening of vibrations, reduction of noise and/or control of sudden shocks after an impact. Significant vibrations and/or sudden shocks may further contribute to brain injury of a wearer. However, minor vibrations and shocks might not be violent enough to cause a traumatic brain injury, but the repetitive nature of some shocks may lead to subconcussive events—events that are defined as brain damage and not currently defined as a traumatic brain injury. As commonly known, the brain, the car, and other sensory organs are control centers for vibrations, and absorbing the vibrations and using them to help the body cope with gravity, move spatially, communicate, and/or react to threats. Injury from even minor, repetitive vibrations and/or sudden shock can result in the loss of sensory neuronal cells, can weaken the ability to mediate vibrations, can cause problems with hearing, can affect the equilibrium, can instigate migraine headaches, and/or initiate other health issues.

New Helmet System with Improved Facemask

As a result, there is a need for a new helmet system with an improved facemask design that desirably redistributes the pressure, redistributes the forces, improves vibration control, and/or improves sudden shocks from impact events. Furthermore, the new helmet system may be used in conjunction with impact mitigation bumpers, which collectively can significantly enhance protection to the wearer by also reducing peak impact force transmitted to the wearer's head, improve vibration control and/or mitigate sudden shocks.

The new helmet system may be used for a variety of contact sports, such as football, baseball, bowling, boxing, cricket, cycling, motorcycling, golf, hockey, lacrosse, soccer, rowing, rugby, running, skating, skateboarding, skiing, snowboarding, surfing, swimming, table tennis, tennis, or volleyball, any training sessions related athletic activities thereto, and/or any combinations thereof, and/or or by a wearer in a sport and/or occupation wherein the helmet is designed and intended to receive, withstand and absorb multiple impacts during the course of play. Accordingly, the disclosed apparatus, system and methods may be used to design and manufacture a custom helmet system for a variety of occupations, such as construction, military, firemen, emergency responders, and/or utility workers that are particularly susceptible to injury and the protective equipment may help avoid personal injury.

Figure 3A:
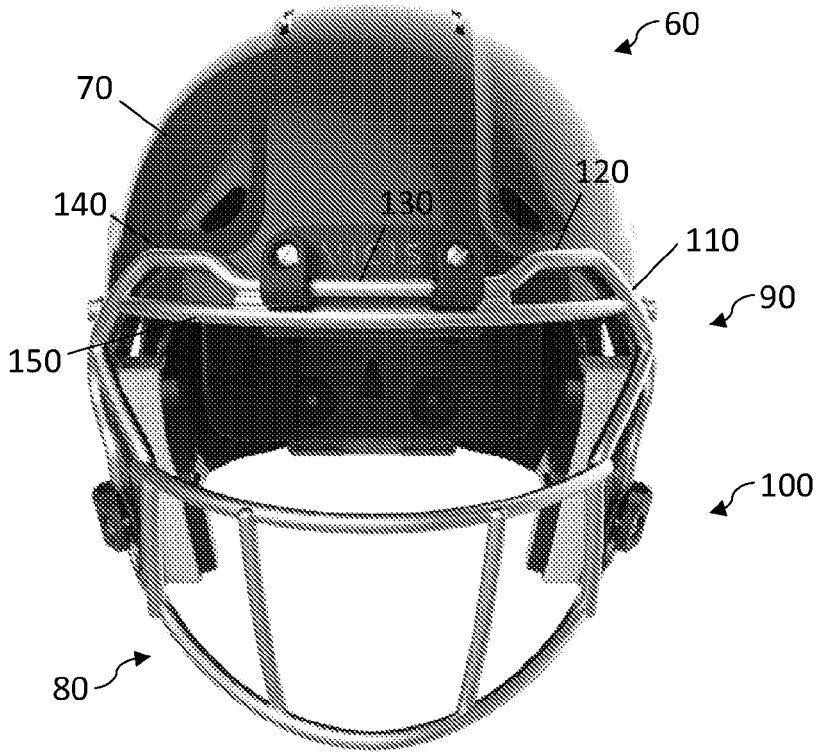
FIGS. 3A-3B depict a front and isometric view of one embodiment of a new helmet design.

FIG. 3A depicts one embodiment of a new helmet system 60. In this embodiment, the new helmet system 60 may comprise a helmet 70 and an improved facemask 80. The helmet may comprise an outer layer. The helmet may further comprise an impact mitigation layer (not shown) and/or an inner layer (not shown), wherein the impact mitigation layer may be disposed between the outer layer and the inner layer. Desirably, the impact mitigation layer will comprise at least a portion of various impact mitigation structures, including filaments, laterally supported filaments, chevron or zigzag structures, inflatable air bladders, cones, shock absorbers, shock suspension systems, foams, auxetic structures, 3D printed structures, and/or any combinations thereof.

In at least one embodiment, the impact mitigating structures can comprise at least a portion of filaments. The at least a portion of filaments may be thin, longitudinally extending members or be shaped and configured to deform non-linearly in response to an impact force. The non-linear deformation behavior is expected to provide improved protection against high-impact forces, and/or oblique forces. The non-linear deformation behavior is described by at least a portion of the filaments stress-strain profile. The non-linear stress-strain profile illustrates that there can be an initial rapid increase in force (region I) followed by a change in slope that may be flat, decreasing or increasing slope (region II), followed by a third region with a different slope (region III).

In another embodiment, the at least a portion of the filaments may comprise filaments that buckle in response to an incident force, where buckling may be characterized by a localized, sudden failure of the filament structure subjected to high compressive stress, where the actual compressive stress at the point of failure is less than the ultimate compressive stress that the material is capable of withstanding. Furthermore, the at least a portion of the filaments may be configured to deform elastically, allowing the at least a portion of the filaments to substantially return to their initial configuration once the external force is removed.

In another embodiment, the impact mitigating structures can comprise at least a portion of a plurality of filaments that are interconnected by laterally positioned walls or sheets in a polygonal configuration, otherwise known as laterally supported filaments (LSF). The filaments and/or the laterally positioned walls can be arranged in structural patterns, if desired. The structural patterns may include polygonal structures known in the art may be contemplated, such as triangular, square, pentagonal, hexagonal, septagonal, octagonal, and/or any combination thereof. A plurality of sheets or lateral walls can be secured between adjacent pairs of filaments with each filament having a pair of lateral walls attached thereto. For example, a hexagonal pattern may allow the lateral walls to be oriented symmetrically approximately 120 degrees apart about the filament axis, with each lateral wall extending substantially along the longitudinal length of the filament. Alternatively, the hexagonal pattern may allow at least one lateral wall to be asymmetric, which the angle of the wall may be between 90 to 135 degrees. The shape, wall thickness or diameter, height, and configuration of the lateral walls and/or filaments may vary as shown to "tune" or "tailor" the structures to a desired performance. For example, one embodiment of a polygonal pattern may have a tapered configuration and/or a frusto-conical shape. The polygonal structure and/or pattern can have a top surface and a bottom surface, with the bottom surface perimeter (and/or bottom surface thickness/diameter of the individual elements) that may be larger than the corresponding top surface perimeter (and/or individual element thickness/diameter). In another example, the polygonal structure can have an upper ridge, the upper ridge extending substantially perpendicular and/or perpendicular to the normal plane of the polygonal structure. The upper ridge can also facilitate connection to another structure, such as an inner surface of a helmet, an item of protective clothing, and/or a mechanical connection (e.g., a grommet or plug having an enlarged tip that is desirably slightly larger than the opening in the upper ridge of the hexagonal element).

Furthermore, the polygonal or hexagonal structures/patterns may be manufactured as individual structures or in a patterned array. The individual structures can be manufactured using an extrusion, investment casting or injection molding process. Each individual polygonal or hexagonal structure/patterns may be affixed directly to a base in a custom location or pattern that may be arranged in continuous or segmented array. Also, they may have the same shape and configuration with repeating symmetrical arrangement or asymmetrical arrangement and/or different shape and configurations with repeating symmetrical arrangement or asymmetrical arrangement.

Conversely, the polygonal or hexagonal structures/patterns may be manufactured directly into a patterned array that is affixed to at least one base membrane. The base membrane may be manufactured with a polymeric or foam material. The polymeric or foam material may be flexible and/or elastic to allow it to be easily bent, twisted or flexed to conform to complex surfaces. Alternatively, the polymeric and/or foam material may be substantially rigid. The manufacturing of each patterned array of polygonal or hexagonal structures may include extrusion, investment casting or injection molding process. The base membrane with the polygonal or hexagonal structures may be affixed directly to at least a portion of the base or the entirety. Affixing each patterned array of polygonal or hexagonal structures may be arranged in continuous or segmented arrays. Also, the polygonal or hexagonal structures may have the same shape and configuration with repeating symmetrical arrangement or asymmetrical arrangement and/or different shapes and configurations with repeating symmetrical arrangement or asymmetrical arrangement.

In another embodiment, the impact mitigation structure may comprise at least a portion of auxetic structures. The auxetic structures may include a plurality of interconnected members forming an array of reentrant shapes positioned on the flexible head layer. Such auxetic structures may be coupled or affixed to the shell protrusion as a continuous layer or in segmented arrays. The term "auxetic" generally refers to a material or structure that has a negative Poisson ratio, when stretched, auxetic materials or structures become thicker (as opposed to thinner) in a direction perpendicular to the applied force. Such auxetic structures can result in high energy absorption and/or fracture resistance. In particular, when a force is applied to the auxetic material or structure, the impact can cause it to expand (or contract) in one direction, resulting in associated expansion (or contraction) in a perpendicular direction. It should be recognized that those skilled in the art that auxetic structures may to include differently shaped segments or other structural members and different shaped voids. For example, an auxetic structure may comprise "bone" or "ribbon" shaped with radiused or arced re-entrant shapes.

In another embodiment, the impact mitigation structure may comprise a portion of a foam material or foam layer. The one or more foam layers or materials can include polymeric foams, quantum foam, polyethylene foam, ethylene-vinyl acetate (EVA) foam, XPS foam, thermoplastic polyurethane foam (foam rubber), XPS foam, polystyrene, phenolic, memory foam (traditional, open cell, or gel), Ariaprene, impact absorbing foam (e.g., VN600), latex rubber foam, convoluted foam ("egg create foam"), Evlon foam, impact hardening foam, 4.0 Custula comfort foam (open cell low density foam), TPU foam and/or any combination thereof. The at least one foam layer may have an open-cell structure or closed-cell structure. The at least one foam layer can be further tailored to obtain specific characteristics, such as anti-static, breathable, conductive, hydrophilic, high-tensile, high-tear, controlled elongation, and/or any combination thereof. The foam layer and/or the impact mitigation structure may have a thickness ranging from 7 mm to 25 mm.

In another embodiment, the at least a portion of the impact structures may be incorporated into an impact pad. The impact pad may comprise at least one top layer, at least one bottom layer, and/or one or more impact structures. The at least one bottom layer or least one top layer may comprise a plastic material, a foam material or foam layer, a resilient fabric that may be a two-way or four-way stretch material and/or any clastic material. The at least one top layer and at least one bottom layer may be the same material, or they may be different materials. The at least one foam layer may a one single layer, and/or it may be a plurality of foam layers (two or more).

In another embodiment, the impact mitigation structure comprises at least a portion of a microlattice. The microlattice may desirably exhibit high strength, elasticity and/or flexibility without permanent deformation, and/or may contain significant energy absorption properties, making it suitable for vibration, acoustic and/or shock-based damping. A microlattice is a plurality of struts stacked in different arrangements, where most of the volume is occupied by air voids. The mechanical properties of the one or more microlattice layers may be adjusted to a wearer's sport position and/or occupation. The mechanical properties may be modified by changing the base material, size and shape of air voids, the periodicity, and connectivity of struts, the strut dimensions, strut porosity, and/or any combination thereof. The at least a portion of a microlattice may further comprise one or more microlattice layers. If two or more microlattice layers are desired, they may be stacked, and/or have different orientations, shapes, mechanical properties, and/or any combination thereof. Alternatively, the two or more microlattice layers may be positioned planar, have the same orientations and/or shapes. Furthermore, the impact mitigation structure comprises at least one impact pad and at least a portion of a microlattice.

In an embodiment, the one or more microlattice layers may be 3D printed. Such 3D printing technologies that may be available can be selected from one or more different 3D printing technologies, including material jetting, power bed fusion, material extrusion, sheet lamination, directed energy deposition, photopolymerization, binder jetting and/or any combination thereof. More specifically, the 3D printing technologies may include fused deposition modeling (FDM), fused filament fabrication (FFF), directly ink writing (DIW), sterco lithography apparatus (SLA), digital light procession (DLP), laminated object manufacturing (LOM), selective laser sintering (SLS), direct metal laser sintering (SLM), selective laser melting (SLM), photopolymer jetting (Polyjet), 3D power binder jetting (3DP), digital light synthesis (DLS), continuous liquid interface production (CLIP), and/or any combination thereof. For example, selecting DLS and CLIP in combination with digital light projection, oxygen permeable optics, and/or programmable liquid resins may be used to produce the custom fit pod assembly resulting with a finished product with excellent mechanical properties, resolution and/or surface finish. Accordingly, the different molding processes may comprise blow molding, compression molding, injection molding, thermoforming and/or any combination thereof.

In another embodiment, the one or more microlattice layers may be manufactured from various other technologies. Such other technologies include injection molding, electron beam melting (EBM), photopolymer wave guides, investment casting, deformation forming, woven textile approach (e.g., weaving and/or braiding thin longitudinal members to produce an open-cell woven structure), non-woven textile approach (e.g. stacking two or more patterned structures and/or layers and joining them together by standard methods known in the art, and it may also involve bending the two or more patterned structures and/or layers to form a microlattice).

In the disclosed embodiment, the helmet 70 further has a front portion and a back portion, as shown in FIG. 3A and FIGS. 5A-5H. The facemask 80 is desirably removably connected to the helmet 70, with the facemask 80 having a plurality of rod-like segments or bars that, when connected together, can create a protective lattice or, screen. or "cage." The plurality of rod-like segments or plurality of bars may have a diameter range of ⅛ inch to 2 inches, or other diameters and/or cross-sectional shapes known in the art.

In an embodiment, the facemask 80 may comprise an upper portion 90 and a lower portion 100, the upper portion 90 including a top bar 110 and a lower bar 150, the top bar 110 having a first arched section 120, a second arched section 140, and a central section 130, the first arched sections 120 and the second arched section 140 being bent upwardly away from a portion of the top bar central section 130 creating a distance, the distance being less than a multiple of the diameter of the top bar central section 130, at least a portion of the top bar central section 130 being coupled to a portion of the lower bar 150 through at least one horizontal member, the at least one horizontal member having a width and a length, the at least one horizontal member having a width greater than length. The lower bar 150 extending beyond the top bar 110, and in at least one embodiment at least a portion of the lower bar 150 contacts a portion of the top bar 110, with an extension distance being at least one-half bar diameter to at least a multiple bar diameter beyond the top bar. Contact may include abutment, fusing, mechanical connections, and/or any combination thereof. Fusing may comprise of stick welding (SMAW, gas metal arc welding (GMAW), gas tungsten arc welding (GTAW), oxy-fuel welding, flux-cored arc welding (FCAW), submerged arc welding (SAW), electrosag welding (ESW), electro resistance welding (ERW), ultrasonic welding, friction welding, laser beam welding, electron beam welding and/or any combination thereof. Mechanical connections may include adhesive, hook and loop, screws, and other connections known in the art.

Figure 3B:
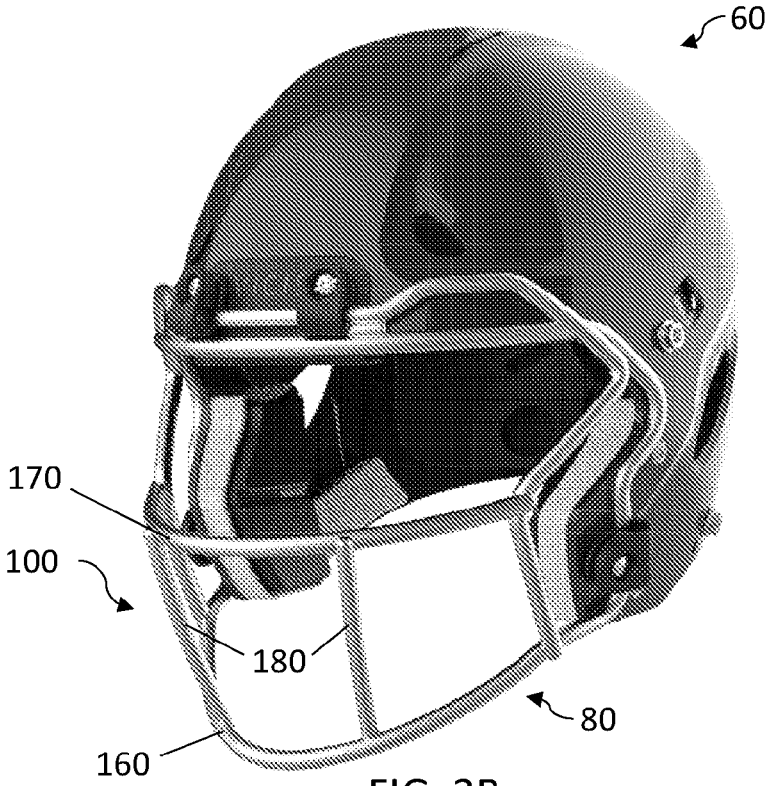

FIG. 3B depicts an isometric view of one embodiment of a new helmet system 60 with a facemask 80. The facemask 80 illustrates the lower portion 100. The lower portion 100 having at least a top bar 170 and a lower bar 160. The lower portion 100 further comprising one or more vertical bars 180. Each of the one or more vertical bars 180 may be positioned equidistant and/or symmetric to the adjacent one or more vertical bars 180. Alternately, each of the one or more vertical bars 180 may be positioned non-equidistant and/or asymmetric to the adjacent one or more vertical bars 180. More specifically, FIG. 3B illustrates the lower portion 100 having at least 2 vertical bars spaced equidistant from the opposing adjacent vertical bar. Accordingly, FIGS. 5A-5H depict the same facemask as shown in FIGS. 3A-3B.

Figure 4A:
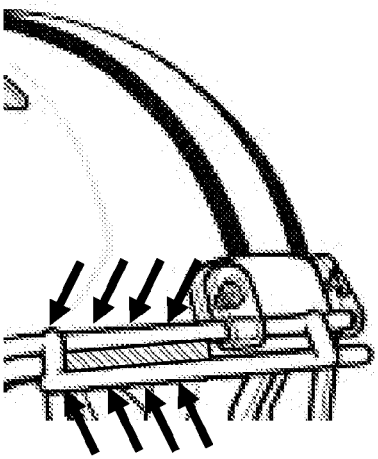
FIGS. 4A-4B illustrate a magnified view comparison of the distribution of forces in a localized area between the new helmet design and prior art helmet designs.
Figure 4B:
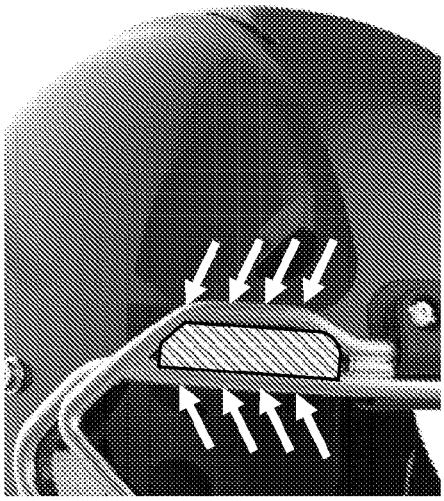
Figure 5A:
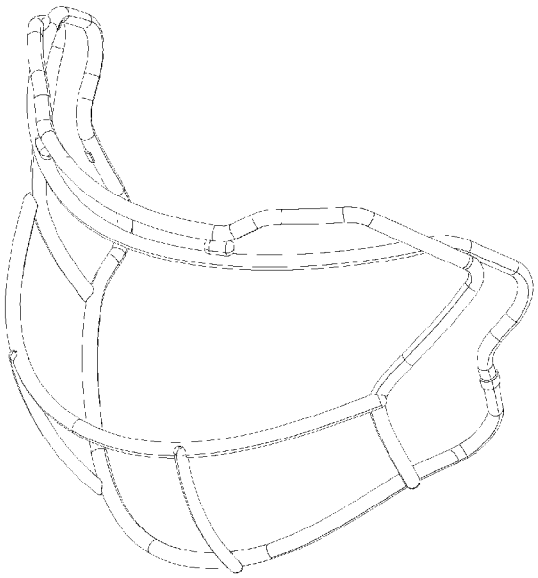
FIGS. 5A-5H depict various views of one embodiment of an improved facemask.
Figure 5B:
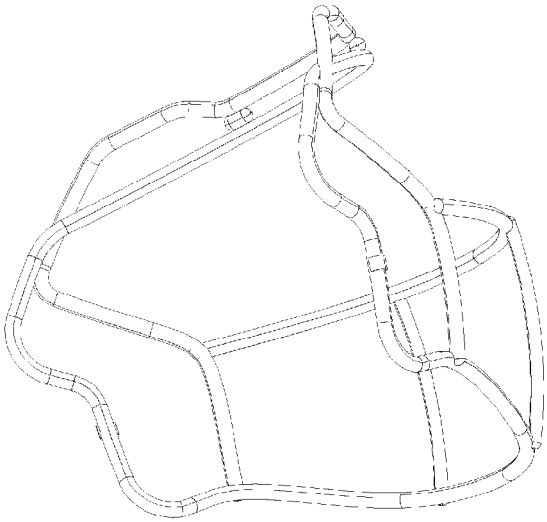
Figure 5C:
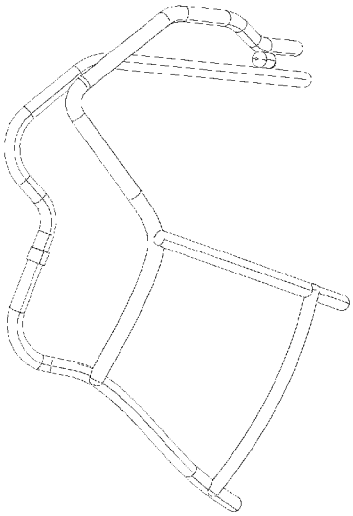
Figure 5D:
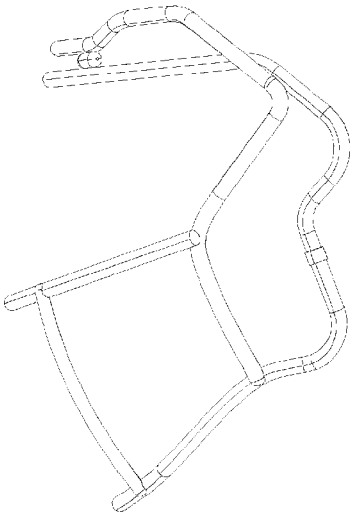
Figure 5E:
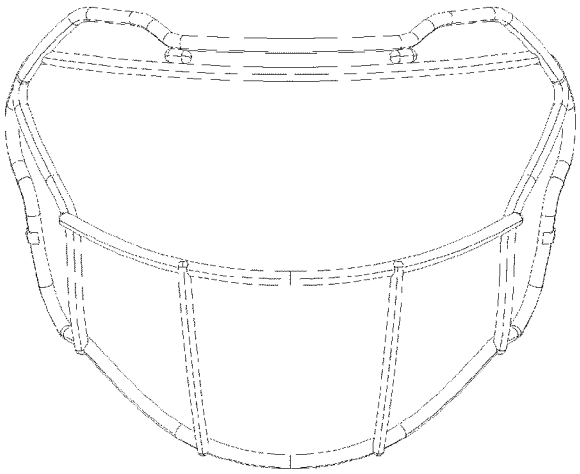
Figure 5F:
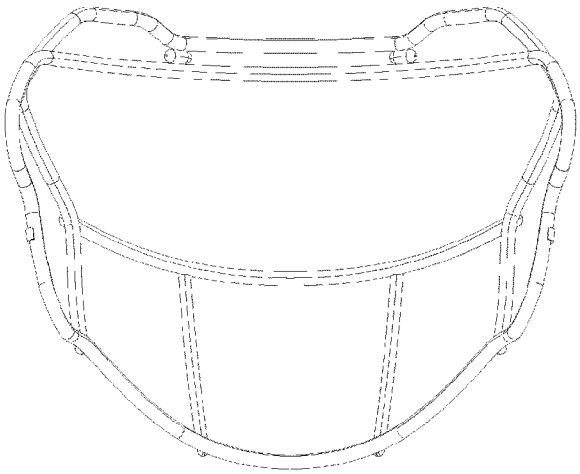
Figure 5G:
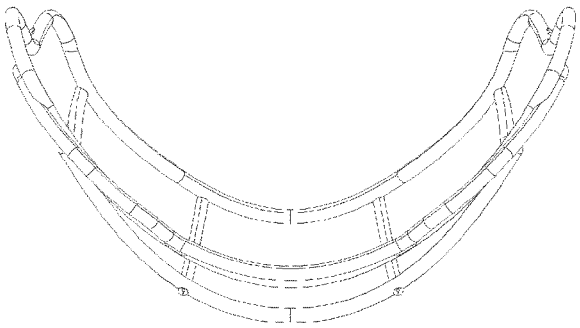
Figure 5H:
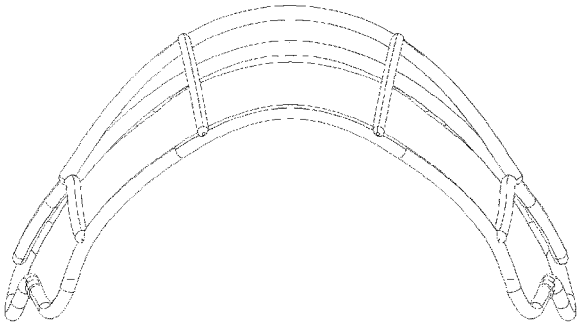

FIGS. 4A-4B shows a magnified isometric view of one structural comparison between the traditional 2-bar facemask variation (FIG. 4A) and the improved facemask variation disclosed herein (FIG. 4B). At best seen on FIG. 4B, the improved facemask variation includes an upwardly extending region which allows for varying levels of deformation of the facemask in that region, facilitating the redistribution of pressures and/or forces helmet from a facemask impact, thereby allowing for mitigation of the total impact of the facemask to the helmet and ultimately to the wearer's head.

FIGS. 6A-6H depict various views of an alternate embodiment of a facemask 190. The facemask 190 having an upper portion 200 and a lower portion 210, the upper portion 200 including a top bar 220 and a lower bar 260, the top bar 220 having a first arched section 230, a second arched section 250, and a central section 240, the first arched section 230 and second arched section 250 is bent upwardly away from the top bar central section 240 creating a distance, the distance being less that a multiple of the diameter of the top bar central section 240, the at least a portion of the top bar central section 240 being coupled to at least a portion of the lower bar 260 through at least one horizontal member, the at least one horizontal member having a width and a length, the at least one horizontal member having a width greater than the length. The lower bar 260 extending beyond the top bar 220, and at least a portion of the lower bar 260 contacts a portion of the top bar 220, with an extension distance being at least one-half bar diameter to at least a multiple bar diameter beyond the top bar. Contact may include abutment, fusing, mechanical connections, and/or any combination thereof. Fusing may comprise of stick welding (SMAW, gas metal arc welding (GMAW), gas tungsten arc welding (GTAW), oxy-fuel welding, flux-cored arc welding (FCAW), submerged arc welding (SAW), electrosag welding (ESW), electro resistance welding (ERW), ultrasonic welding, friction welding, laser beam welding, electron beam welding and/or any combination thereof. Mechanical connections may include adhesive, hook and loop, screws, and other connections known in the art.

Figure 6A:
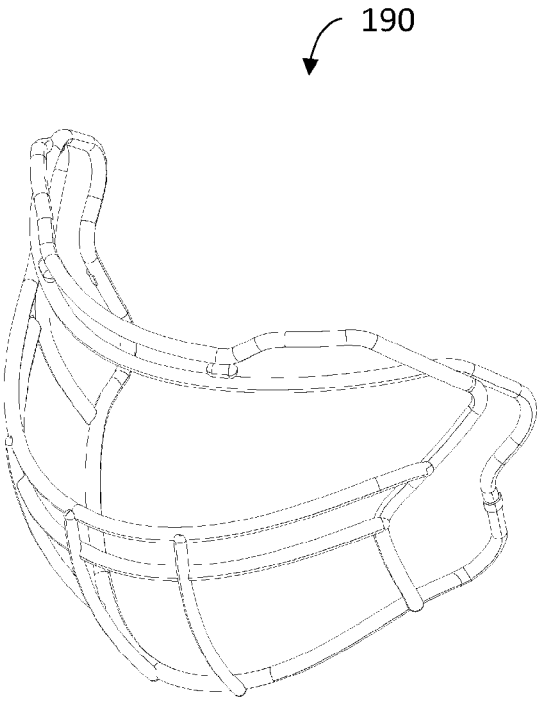
FIGS. 6A-6H depict various views of one alternate embodiment of an improved facemask.
Figure 6B:
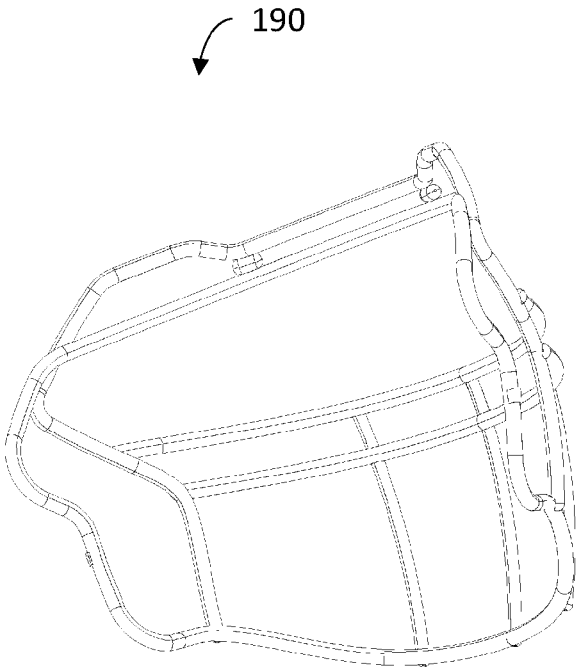
Figure 6C:
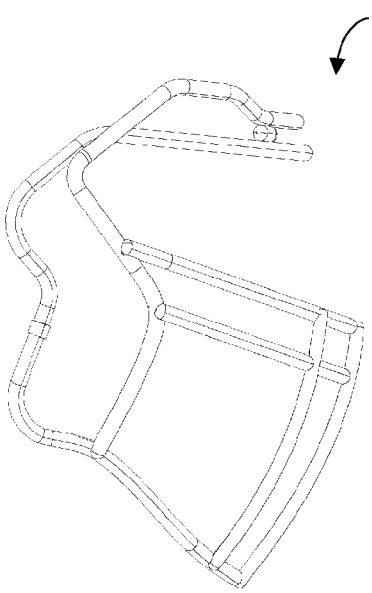
Figure 6D:
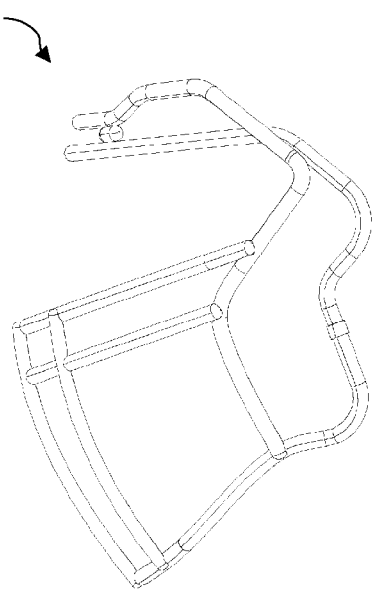
Figure 6E:
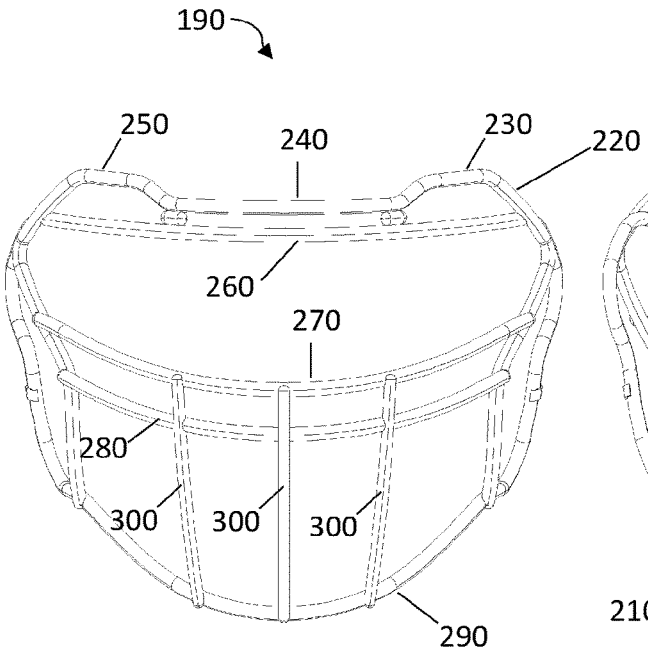
Figure 6F:
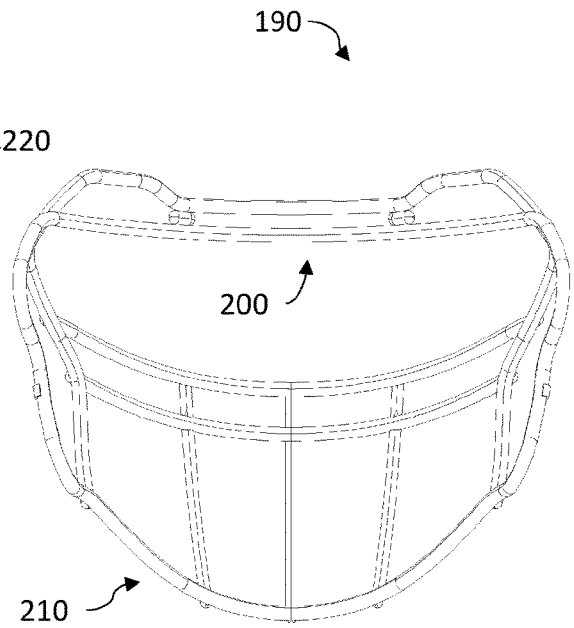
Figure 6G:
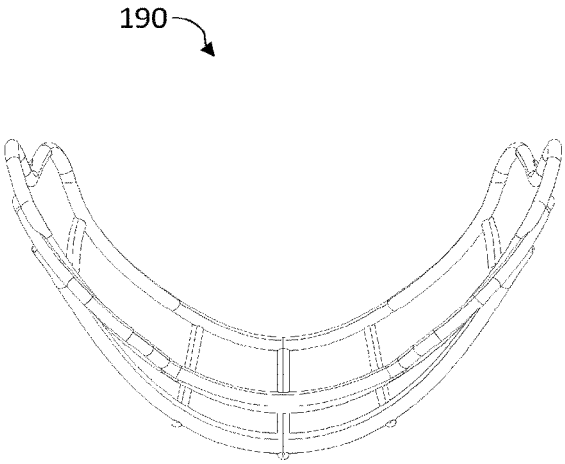
Figure 6H:
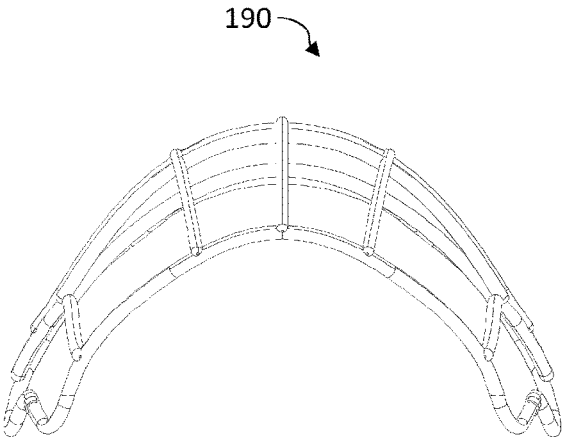

The lower portion 210 comprises at least one top bar 270, at least one bottom bar 290, and one or more vertical bars 300. The lower portion 210 may further comprise a second top bar 280. Each of the one or more vertical bars 300 may be positioned equidistant and/or symmetric to the adjacent one or more vertical bars 300. Alternately, each of the one or more vertical bars 300 may be positioned non-equidistant and/or asymmetric to the adjacent one or more vertical bars 300. More specifically, FIG. 6E illustrates the lower portion 310 having at least three vertical bars spaced equidistant from the opposing adjacent vertical bar.

FIGS. 7A-7H depict various views of an alternate embodiment of a facemask 310. The facemask 310 having an upper portion 320, a central portion 330 and a lower portion 340. The upper portion 320 including a top bar 350 and a lower bar 380, the top bar 350 having a first arched section 360, a second arched section 390, and a central section 370, the first arched section 360 and the second arched section 390 are bent upwardly away from the lower bar 380 creating a distance, the distance being less than a multiple of the diameter of the top bar central section 370, at least a portion of the top bar central section 370 being coupled to at least a portion of the lower bar 380 through at least one horizontal member, the at least one horizontal member having a width and a length, the at least one horizontal member having a width greater than the length. The lower bar 260 extension may optionally extend beyond the top bar 220, and at least a portion of the lower bar 260 contacts a portion of the top bar 220, with an extension distance being at least one-half bar diameter to at least a multiple bar diameter beyond the top bar. Contact may include abutment, fusing, mechanical connections, and/or any combination thereof. Fusing may comprise of stick welding (SMAW, gas metal arc welding (GMAW), gas tungsten arc welding (GTAW), oxy-fuel welding, flux-cored arc welding (FCAW), submerged arc welding (SAW), electrosag welding (ESW), electro resistance welding (ERW), ultrasonic welding, friction welding, laser beam welding, electron beam welding and/or any combination thereof. Mechanical connections may include adhesive, hook and loop, screws, and other connections known in the art.

Figure 7A:
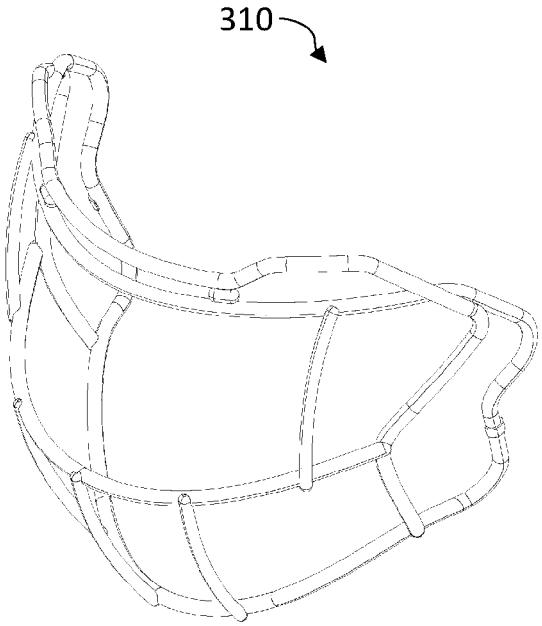
FIGS. 7A-7H depict various views of one alternate embodiment of an improved facemask.
Figure 7B:
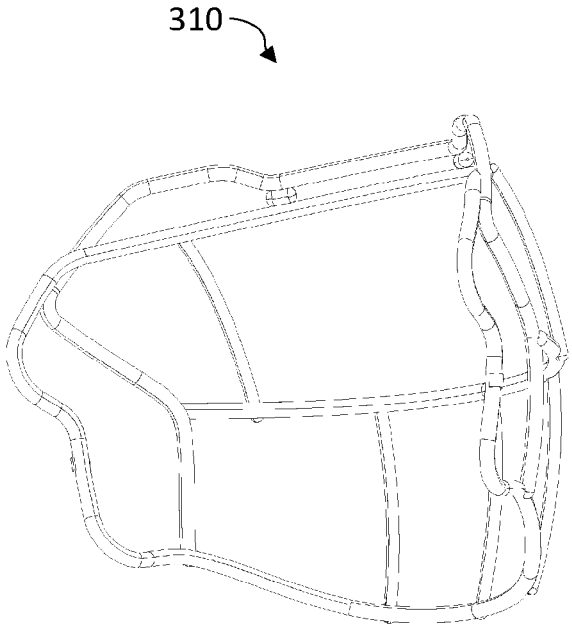
Figure 7C:
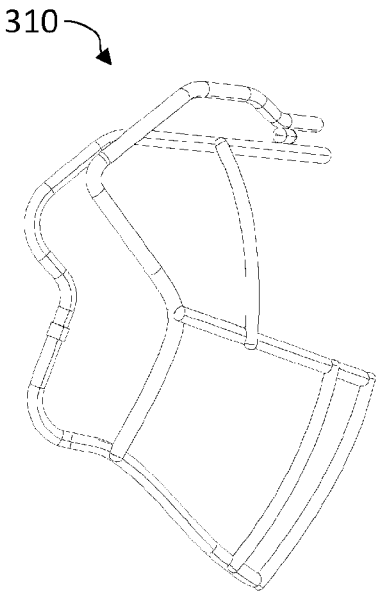
Figure 7D:
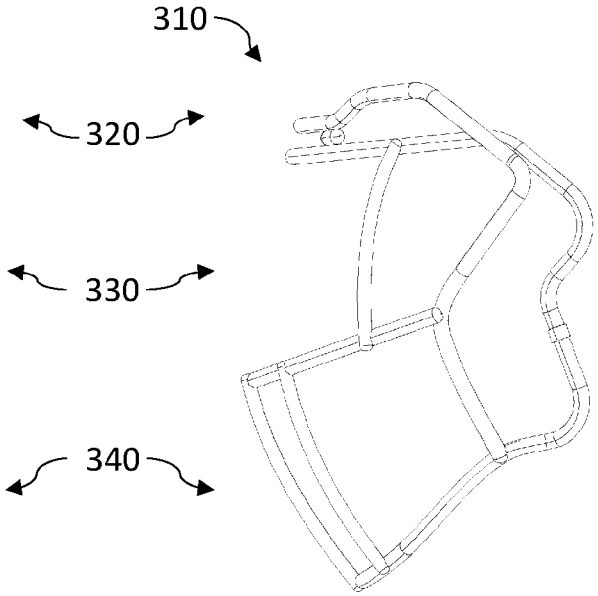
Figure 7E:
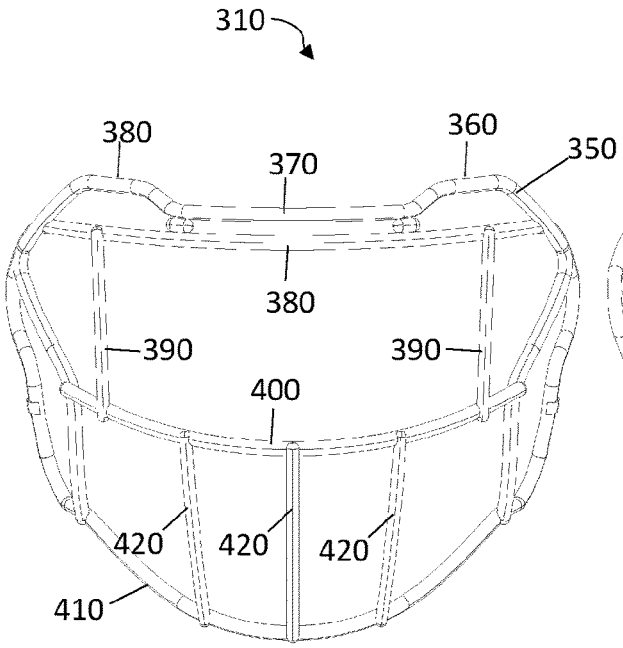
Figure 7F:
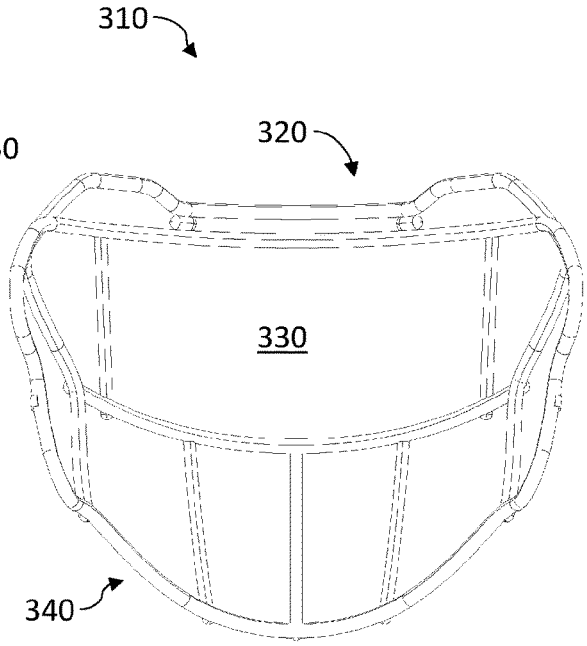
Figure 7G:
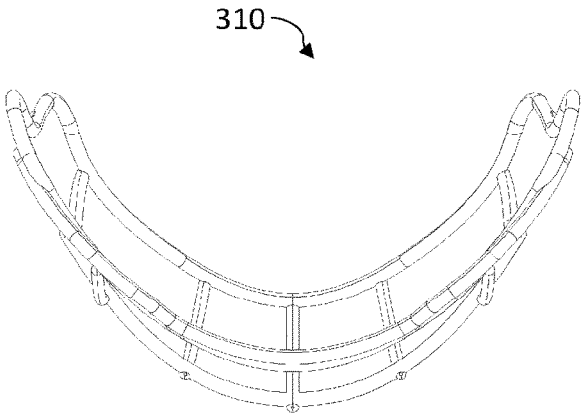
Figure 7H:
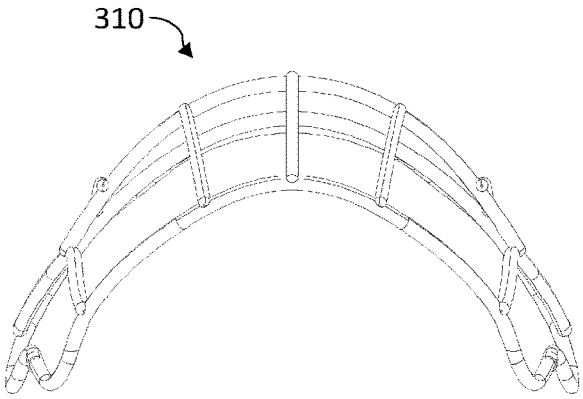

In this embodiment, the facemask 310 further has a central portion 330 comprising at least one eye bar 390 to enhance eye protection. The at least one eye bar 390 extending longitudinally from the top portion 320 lower bar 380 to the bottom portion 340 top bar 400. The at least one eye bar 390 having a first end and a second end. The first and/or the second end coupled to the top portion 320 lower bar 380 and/or the first end and/or the second end coupled to the bottom portion 340 top bar 400. The facemask 310 having a lower portion 340. The lower portion 340 comprises at least one top bar 400, at least one bottom bar 410, and one or more vertical bars 420. Each of the one or more vertical bars 420 may be positioned equidistant and/or symmetric to the adjacent one or more vertical bars 420. Alternately, each of the one or more vertical bars 420 may be positioned non-equidistant and/or asymmetric to the adjacent one or more vertical bars 420. More specifically, FIG. 7E illustrates the lower portion 340 having at least three vertical bars 420 spaced equidistant from the opposing adjacent vertical bars 420.

FIGS. 8A-8H depict various views of an alternate embodiment of a facemask 430. The facemask 430 having an upper portion 440, a central portion 450 and a lower portion 460. The upper portion 440 including a top bar 470 and a lower bar 510, the top bar 470 having a first arched section 480, a second arched section 500, and a central section 490, the first arched section 480 and second arched section 500 is bent upwardly away from the lower bar 510 creating a distance, the distance being less that a multiple of the diameter of the top bar central section 490, at least a portion of the top bar central section 490 being coupled to at least a portion of the lower bar 510 through at least one horizontal member, the at least one horizontal member having a width and a length, the at least one horizontal member having a width greater than the length. The lower bar 260 extending beyond the top bar 220, and at least a portion of the lower bar 260 contacts a portion of the top bar 220. Extension distance being at least one-half bar diameter to at least a multiple bar diameter beyond the top bar. Contact may include abutment, fusing, mechanical connections, and/or any combination thereof. Fusing may comprise of stick welding (SMAW, gas metal arc welding (GMAW), gas tungsten arc welding (GTAW), oxy-fuel welding, flux-cored arc welding (FCAW), submerged arc welding (SAW), electrosag welding (ESW), electro resistance welding (ERW), ultrasonic welding, friction welding, laser beam welding, electron beam welding and/or any combination thereof. Mechanical connections may include adhesive, hook and loop, screws, and other connections known in the art.

Figure 8A:
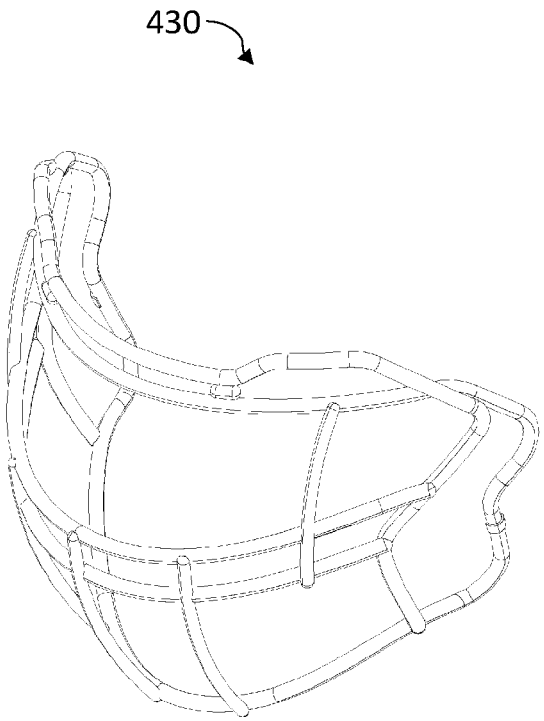
FIGS. 8A-8H depict various views of one alternate embodiment of an improved facemask.
Figure 8B:
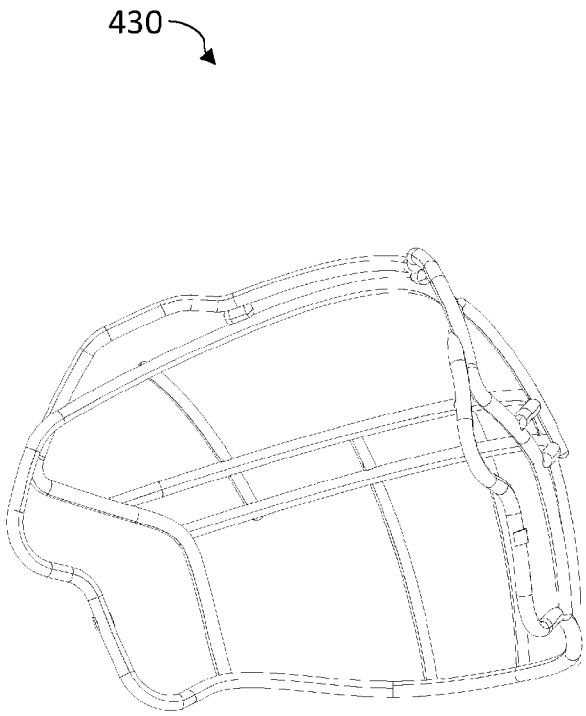
Figure 8C:
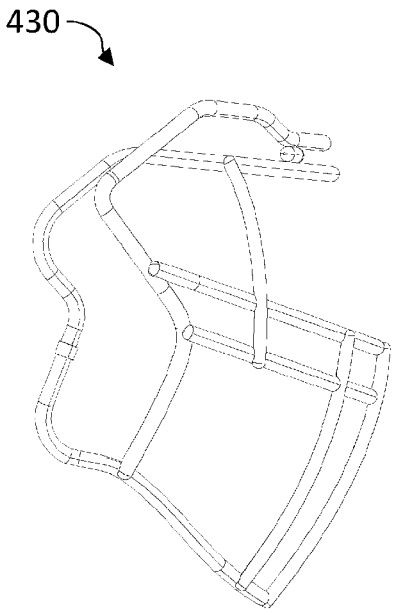
Figure 8D:
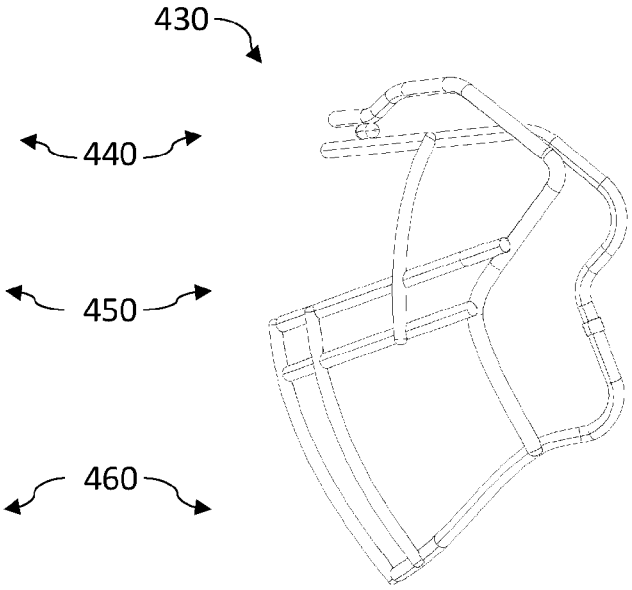
Figure 8E:
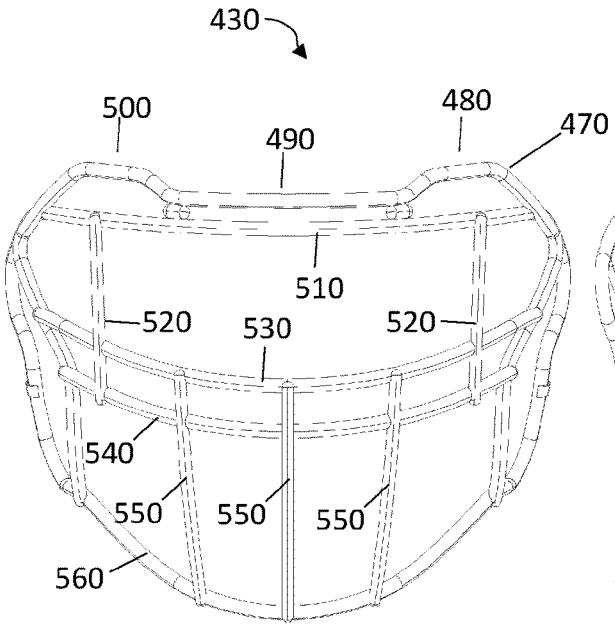
Figure 8F:
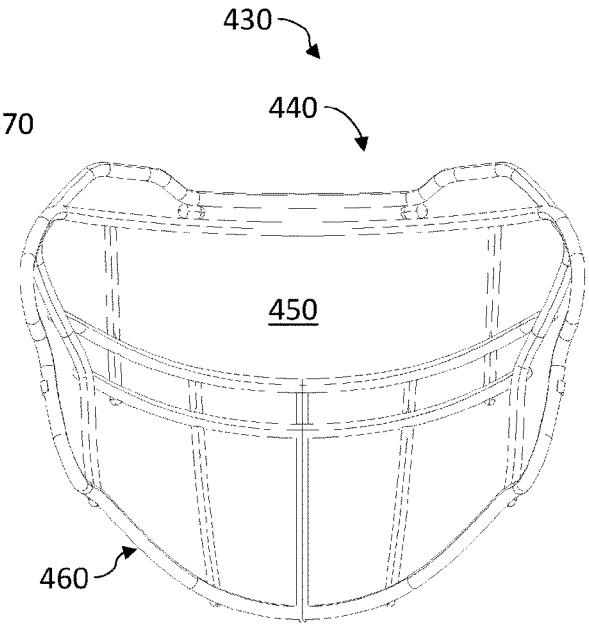
Figure 8G:
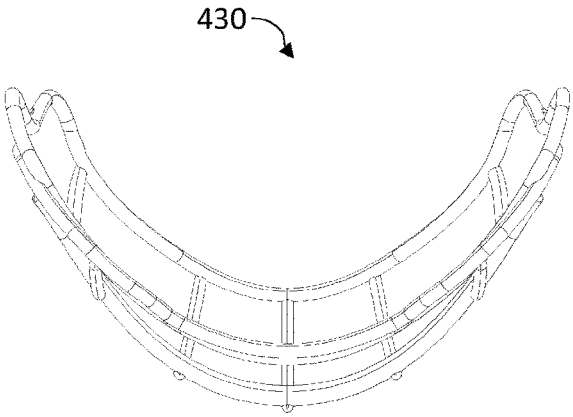
Figure 8H:
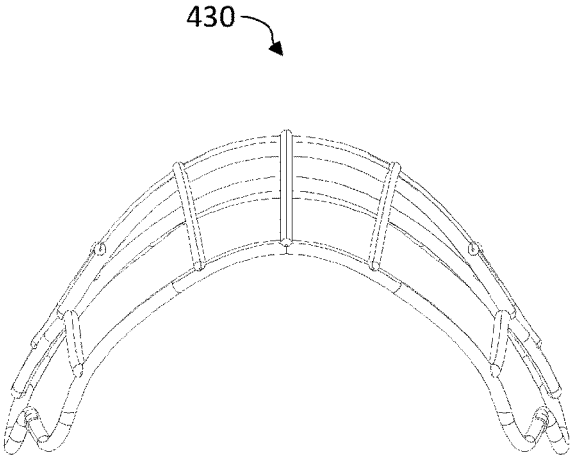

In this embodiment, the facemask 430 has a central portion 450 comprising at least one eye bar 520 to enhance eye protection. The at least one eye bar 520 extending longitudinally from the top portion 440 lower bar 510 to the bottom portion 460 top bar 530. The at least one eye bar 520 having a first end and a second end. The first and/or the second end coupled to the top portion 440 lower bar 510 and/or the first end and/or the second end coupled to the bottom portion 460 top bar 530 and/or the second top bar 540. The facemask 430 having a lower portion 460. The lower portion 460 comprises at least one top bar 530, at least one bottom bar 560, and one or more vertical bars 550. Each of the one or more vertical bars 550 may be positioned equidistant and/or symmetric to the adjacent one or more vertical bars 550. Alternately, each of the one or more vertical bars 550 may be positioned non-equidistant and/or asymmetric to the adjacent one or more vertical bars 550. More specifically, FIG. 8E illustrates the lower portion 460 having at least three vertical bars 550 spaced equidistant from the opposing adjacent vertical bars 550.

Figure 15A:
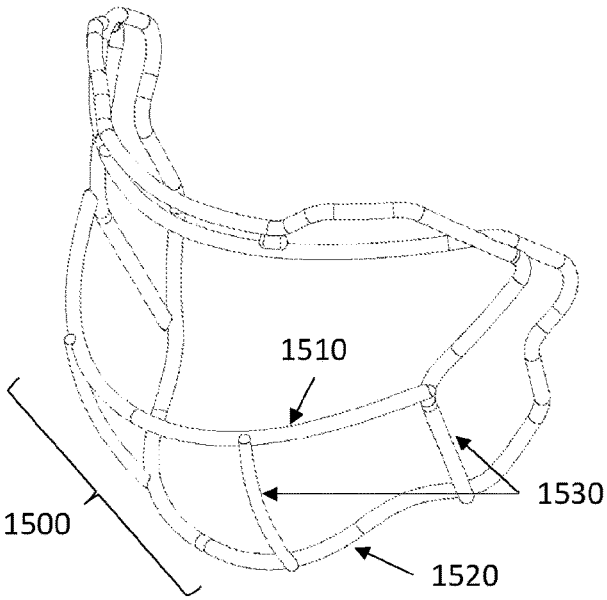
FIGS. 15A-15H depict various views of another exemplary embodiment of an improved facemask.
Figure 15B:
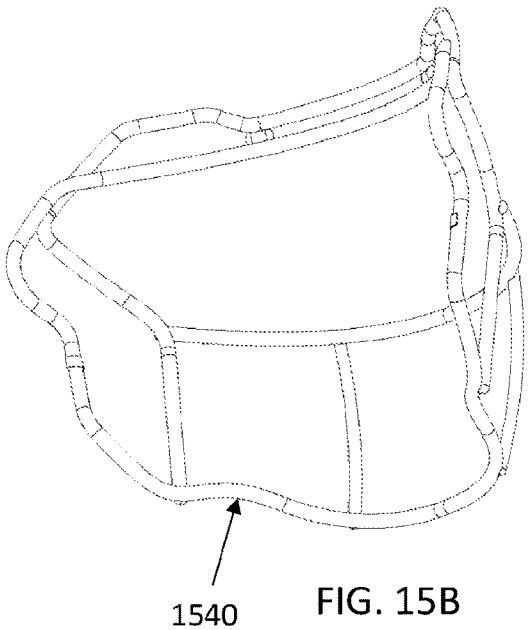
Figure 15C:
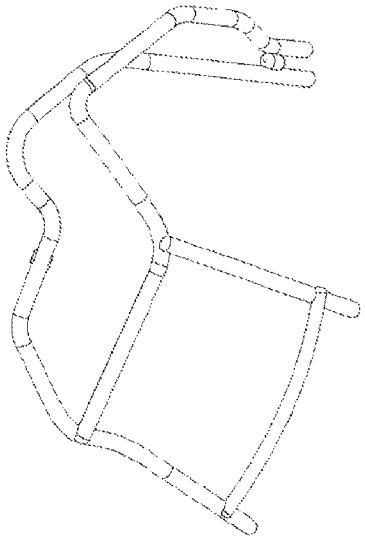
Figure 15D:
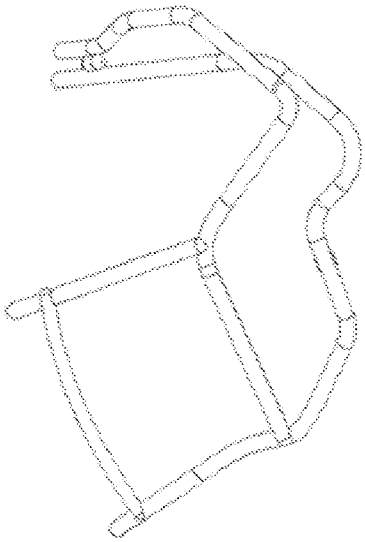
Figure 15E:
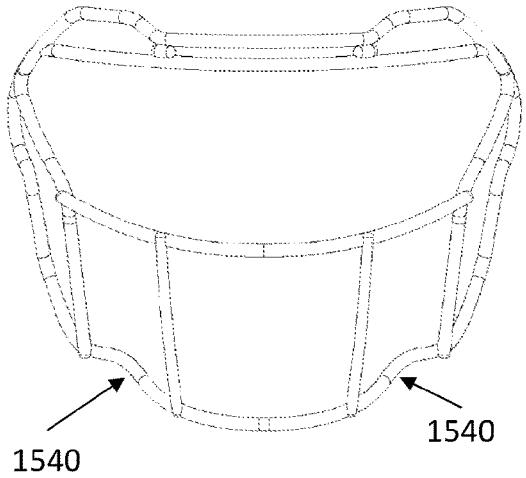
Figure 15F:
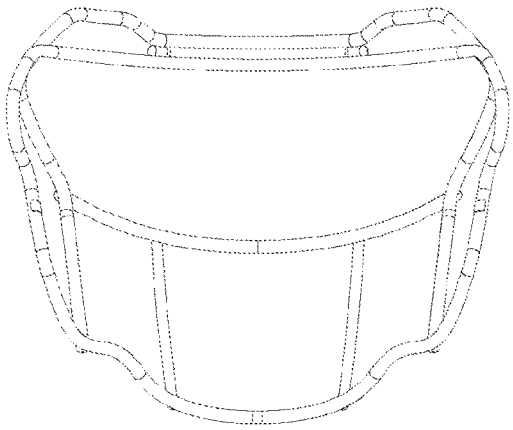
Figure 15G:
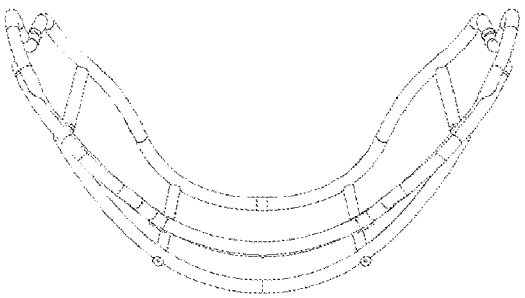
Figure 15H:
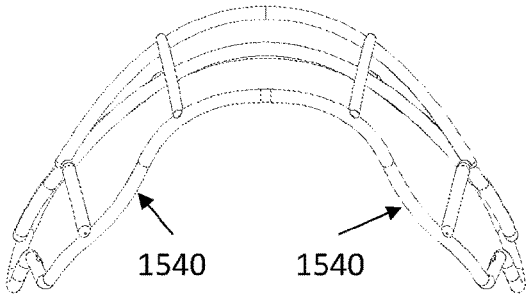
Figure 16A:
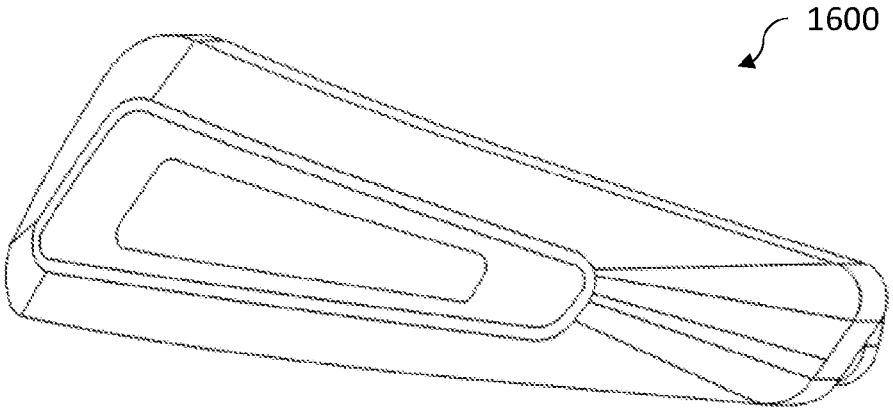
FIGS. 16A-16E depict various views of another exemplary embodiment of an impact mitigation bumper.
Figure 16B:
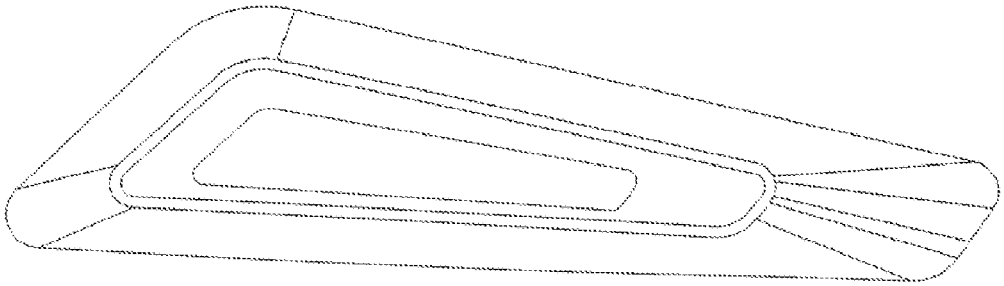
Figure 16C:
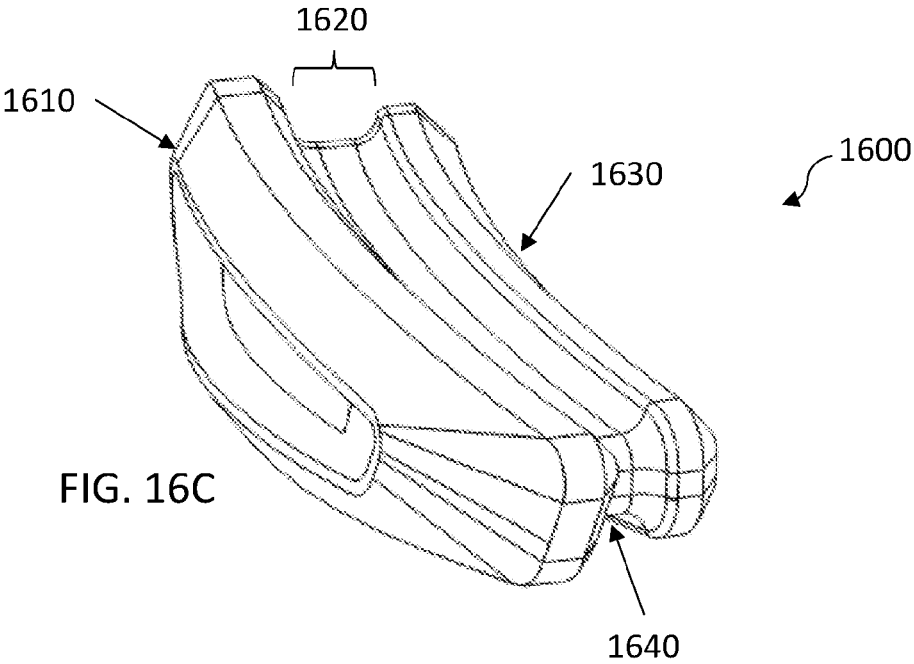
Figure 16D:
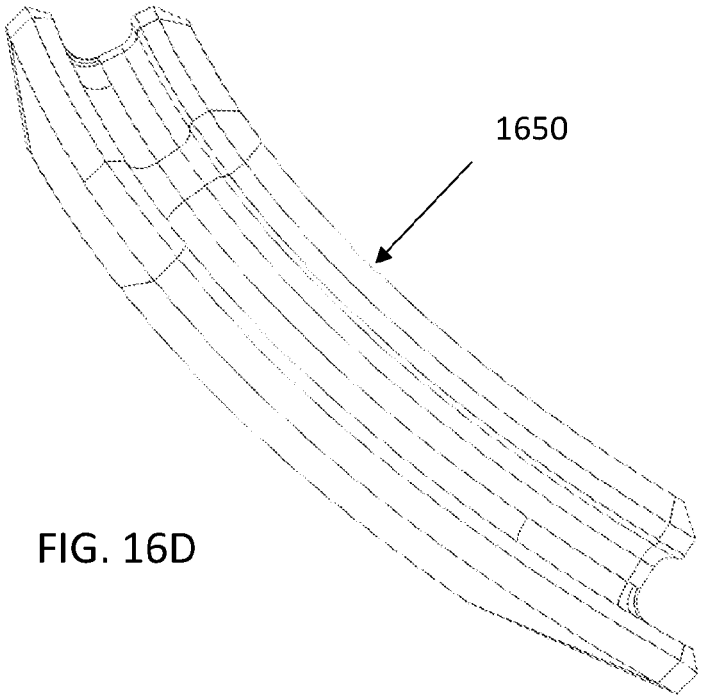
Figure 16E:
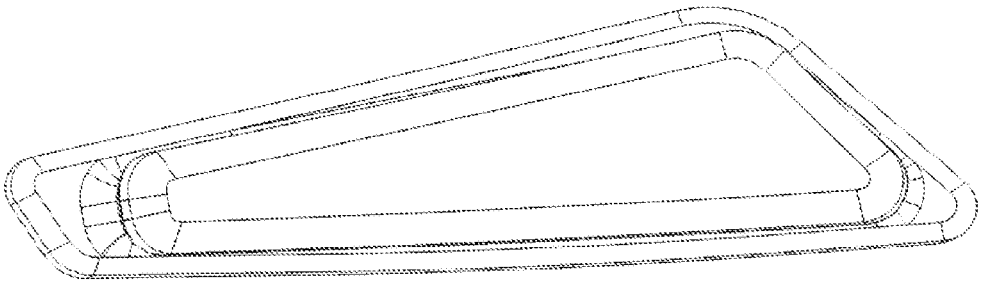
Figure 17A:
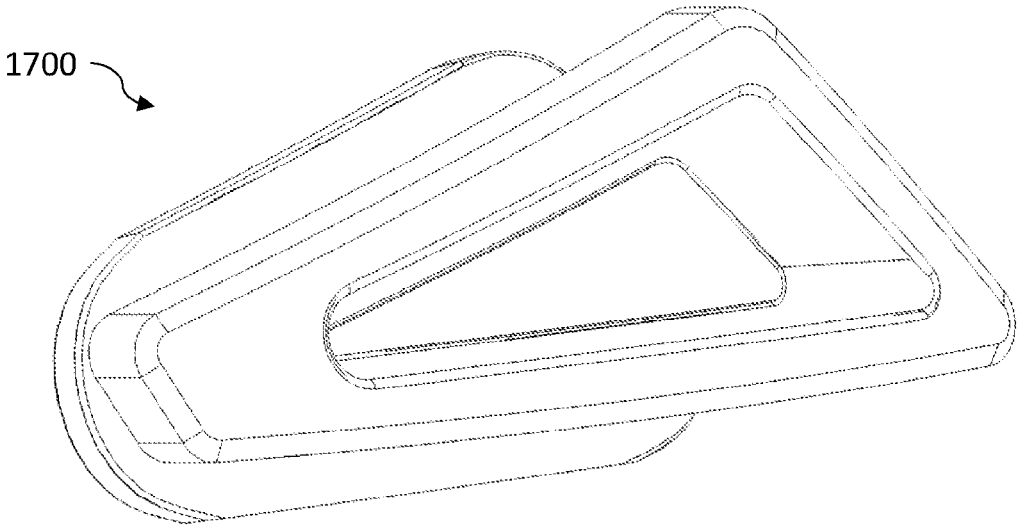
FIGS. 17A-17F depict various views of another exemplary embodiment of an impact mitigation bumper.
Figure 17B:
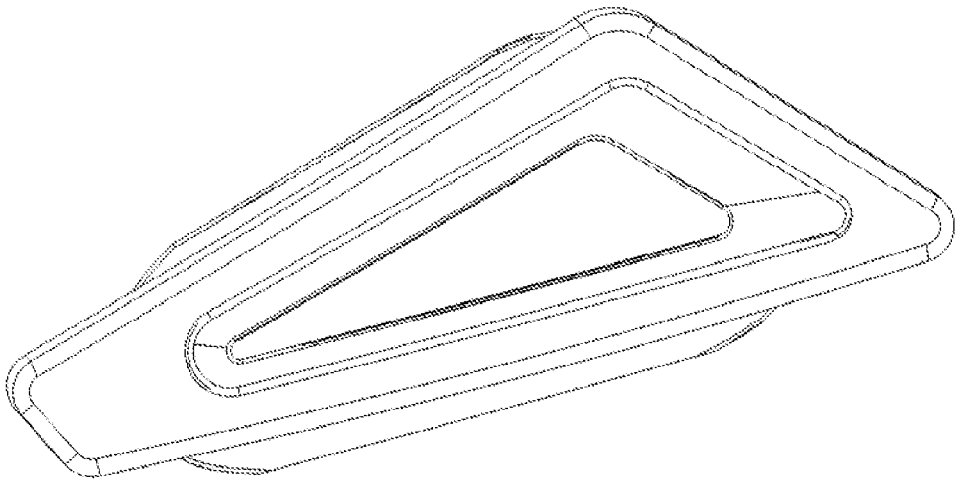
Figure 17C:
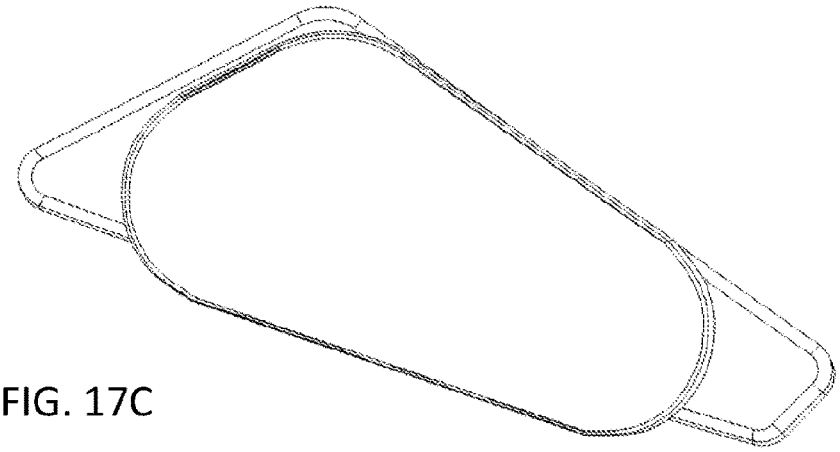
Figure 17D:
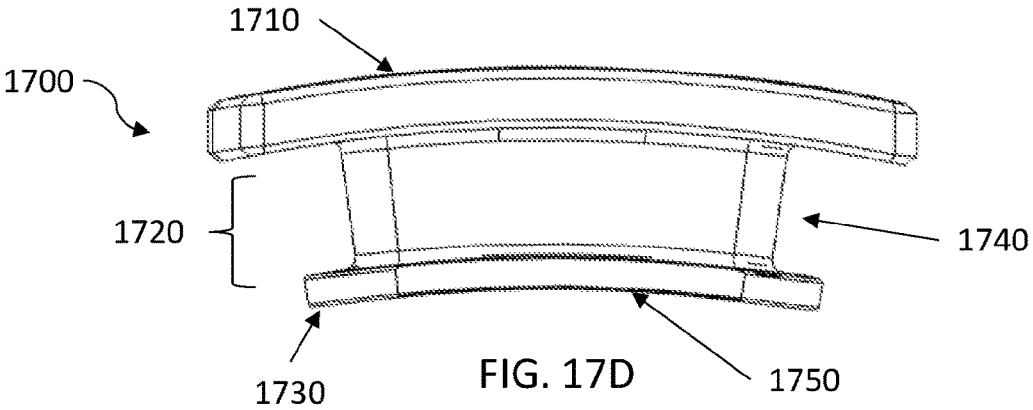
Figure 17E:
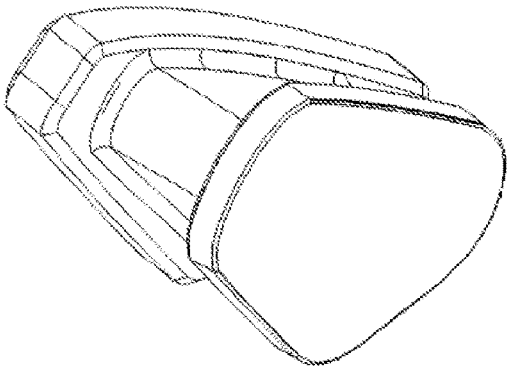
Figure 17F:
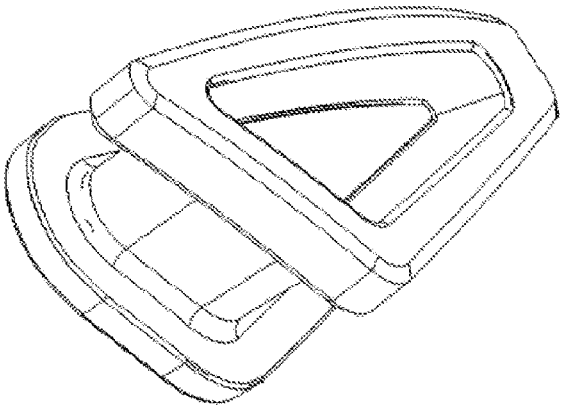

FIGS. 15A-15H depict various views of another alternate embodiment of a facemask. In this embodiment, the facemask includes a lower portion 1500, the lower portion 1500 comprising at least one top bar 1510, at least one bottom bar 1520, and one or more vertical bars 1530. As best seen in FIGS. 15B, 15E and 15H, the bottom bar can include one or more inwardly curved portions 1540, which can desirably be formed to mimic the natural jawline of a wearer in some embodiments, as well as potentially increase the strength and/or flexibility of the facemask in other embodiments. Desirably, the inwardly curved portions will better protect the lower regions of the player's face and/or jaw from impacts, especially impacts which may cause the helmet to unbuckle and/or separate from the wearer's head. In addition, the curved portions 1540 can better allow the facemask to "flex" during impact events in this area, reducing peak impact and/or the potential for plastic bending and/or failure of the facemask.

In any of the aforementioned embodiments, the helmet may further comprise a comfort liner. The comfort liner can desirably improve the comfort and fit of the helmet system on the player. The comfort liner may be a single, unitary piece, the comfort liner may comprise a plurality of comfort liner pads, at least one base layer, and a plurality of fit tabs. The plurality of comfort liner pads can be positioned onto the at least one base layer, where each of the plurality of comfort pads are positioned adjacent to each other with a gap distance. Each of the plurality of comfort pads may be placed in specific regions within the helmet, such as at least one frontal region (or front), an occipital region (or lower-back), a mid-back region, a parietal region (or midline), and a temporal region (right and/or left sides), and/or any combination(s) thereof. The fit tabs are connection mechanisms are desirably placed around the perimeter of the comfort liner to help with securement of the comfort liner to itself and/or the helmet.

Alternatively, the comfort liner may comprise a plurality of comfort liner pads, where each of the individual comfort liner pads are independent from the adjacent individual comfort liner pads. The comfort liner may comprise a plurality of individual comfort pads. The plurality of comfort liner pads can be positioned within the helmet, where each of the plurality of comfort pads are positioned adjacent to each other with a gap distance. Each of the plurality of comfort pads may be placed in specific regions within the helmet, such as at least one of frontal region (or front), an occipital region (or lower-back), a mid-back region, a parietal region (or midline), and a temporal region (right and/or left sides), and/or any combination(s) thereof. The plurality of individual comfort pads may be removably coupled to the helmet. Coupling may include snaps, a Velcro (hook & loop) connection, and/or a flexible member, and/or any combination thereof.

Impact Mitigation Bumpers

In another exemplary embodiment, the new helmet system may comprise one or more impact mitigation bumpers. The one or more impact mitigation bumpers may be retrofitted into commercially-available facemasks and/or be incorporated within manufacturer's own facemask design. The impact mitigation bumpers may enhance protection of the wearer by desirably decreasing the peak force after impact, further distributing impact forces, dampening vibration, reduces noise and/or reducing sudden shock.

Figure 9:
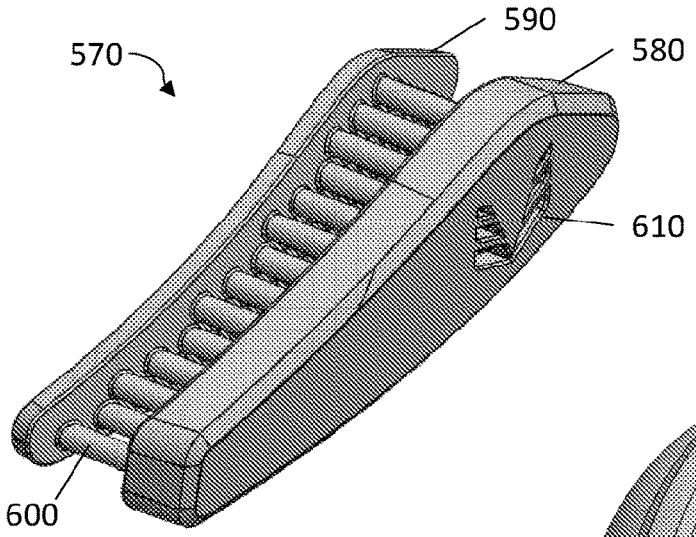
FIG. 9 depicts an isometric view of one embodiment of an impact mitigation bumper.

FIG. 9 depicts an isometric view of an impact mitigation bumper 570. Each of the one or more impact mitigation bumpers 570 may comprise a single unitary piece and/or a multi-unit piece. The single unitary piece may comprise a first portion 580, one or more impact mitigation structures 600, and/or a second portion 590, the one or more impact mitigation structures 600 disposed between the first portion 580 and the second portion 590. The first portion 580 and/or the second portion 590 may further comprise a base, the base allowing at least a portion of the facemask to be positioned onto a portion of the base to allow the facemask to compress and/or wedge the impact mitigation bumper onto the helmet. The one or more impact mitigation structures 600 extend between the first portion 580 and the second portion 590, creating a distance. The distance sized and configured to receive the width and/or diameter of the at least a portion of the facemask. Each of the first portion 580, the impact mitigation structure 600, and/or the second portion 590 may comprise the same material and/or different materials. The one or more impact mitigation structures 600 may desirably comprise the impact mitigation structures disclosed herein. The at least a portion of the one or more impact mitigation structures 600 may comprise filaments, laterally supported filaments, chevron or zigzag structures, inflatable air bladders, auxetic structures, cones, shock absorbers, shock suspension systems, foam layers, and/or any combination thereof.

Alternatively, in another embodiment, the single unitary piece may omit the one or more impact mitigation structures 600. The single unitary piece may comprise a first portion 580 and a second portion 590. The first portion and/or second portion may comprise a body and a central member, the central member having a top end and/or a bottom end, the top or bottom end of the central member coupled to the body, the central member being sized and configured smaller than the body. The first and/or second portion may further comprise a base, the base allowing at least a portion of the facemask to be positioned onto a portion of the base of the helmet to compress and/or wedge the impact mitigation bumper onto the helmet.

In another embodiment, the impact mitigation bumper may comprise a body and a channel. The body having a perimeter, a first end and a second end creating a lateral axis. The channel being positioned between the first end and second end of the body, and running substantially perpendicular to the lateral axis to surround the perimeter or a portion of the perimeter of the body. The channel being sized and configured to receive a width and/or diameter of at least one facemask bar.

In another embodiment, the one or more impact mitigation bumpers 570 may comprise multi-unit pieces that are coupled together to create the usable bumper. The multi-unit bumper may comprise a first portion 580, at least one or more impact mitigation structures 600, and/or a second portion 590, the one or more impact mitigation structures 600 disposed between the first portion 580 and the second portion 590. The one or more impact mitigation structures 600 may desirably comprise the impact mitigation structures disclosed herein. The at least a portion of the one or more impact mitigation structures 600 may comprise filaments, laterally supported filaments, chevron or zigzag structures, inflatable air bladders, auxetic structures, cones, shock absorbers, shock suspension systems, foam layers and/or any combination thereof. Each of the first portion 580, the one or more impact mitigation structures, and/or the second portion 590 may comprise the same material and/or different materials. The one or more impact mitigation structures is coupled to the upper and lower portion. Coupling may include methods and/or mechanical structures known in the art. Such coupling allows the impact mitigation bumper to be removably coupled onto a portion of the facemask by assembling the first portion, second portion and/or the impact mitigation structure over a portion of the facemask like a "clamshell." Furthermore, a "clamshell" like design allows the impact mitigation bumper to accommodate different facemask radiuses and/or widths.

Alternatively, the multi-unit piece may omit the one or more impact mitigation structures 600. The multi-unit piece may comprise of a first portion 580, and a second portion 590. Each of the first portion 580 and/or the second portion 590 may comprise the same material and/or different materials. The first portion 580 is coupled to the second portion 590. Coupling may include methods and/or mechanical structures known in the art. Such coupling allows the impact mitigation bumper to be removably coupled onto a portion of the facemask by assembling the first portion, and/or the second portion over a portion of the facemask like a "clamshell." Furthermore, a "clamshell" like design allows the impact mitigation bumper to accommodate different facemask radiuses and/or widths.

The manufacturing of the single unitary piece and/or the multi-unit piece of each of the one or more impact mitigation bumpers may be 3D printed, casted and/or molded. The 3D printing technologies that may be available can be selected from one or more different 3D printing technologies, including material jetting, power bed fusion, material extrusion, sheet lamination, directed energy deposition, photopolymerization, binder jetting and/or any combination thereof. More specifically, the 3D printing technologies may include fused deposition modeling (FDM), fused filament fabrication (FFF), directly ink writing (DIW), stereo lithography apparatus (SLA), digital light procession (DLP), laminated object manufacturing (LOM), selective laser sintering (SLS), direct metal laser sintering (SLM), selective laser melting (SLM), photopolymer jetting (Polyjet), 3D power binder jetting (3DP), digital light synthesis (DLS), continuous liquid interface production (CLIP), and/or any combination thereof. For example, selecting DLS and CLIP in combination with digital light projection, oxygen permeable optics, and/or programmable liquid resins may be used to produce the custom bumper resulting with a finished product with excellent mechanical properties, resolution and/or surface finish. Accordingly, the different molding processes may comprise blow molding, compression molding, injection molding, thermoforming, investment casting and/or any combination thereof.

In another embodiment, the one or more impact mitigation bumpers 570 may comprise a logo or other identifying information 610. The logo and/or other identifying information 610 may desirably include the manufacturers logo. The identifying information may be the wearer's player number, the wearer's initials, team logo, and/or any combination thereof. The logo and/or other identifying information 610 may be disposed onto a surface of the first portion 580 and/or the second portion 590.

In another embodiment, the first portion 580 and/or the second portion 590 of the impact mitigation bumper 570 may be made of the same material and/or different materials. The first portion 580 and/or the second portion 590 may comprise polycarbonate, one or more foam layers, a gel layer, air-inflated, and/or any combination thereof. Accordingly, the impact mitigation structure may comprise a thermoplastic polyurethane material (TPU). Durometers of the first portion 580 and/or the second portion 590 may range from 30A to 60D.

In another embodiment, the impact mitigation bumpers may be removably coupled to the at least a portion of the facemask and/or at least a portion of the helmet. The removable coupling may comprise mechanical fasteners (e.g., t-nut, snap post, Velcro or hook-and-loop, adhesive), friction-fit or interference fit, compression-fit, overmolding the one or more impact bumpers onto at least a portion of the facemask. For example, the friction fit may involve changing the durometer and/or material type that when coupled to at least a portion of the facemask, the material facilitates the affixation of the impact mitigation bumper to "hold" onto at least a portion of the facemask. Another example is interference fit. Interference fit desirably requires the fastening of two parts in which the inner component that it surrounds is larger than the outer components. This may be desirable for the impact mitigation bumper allowing the distance between the first portion and the second portion to have a smaller distance than at least a portion of the facemask width and/or circumference. Another example of a coupling method may be shrink fitted. The impact mitigation bumper may be placed in its desired location then heated, and the impact mitigation bumper shrinks producing an interference fit.

Alternatively, one or more impact mitigation bumpers can be overmolded to at least a portion of the facemask. The overmolding process may allow the impact mitigation bumper to be more permanently affixed to the at least a portion of the facemask producing a strong bond. The use of primers or adhesives may not be required to achieve an optimum bond. Accordingly, the at least a portion of the facemask may comprise one or more grooves, where the one or more grooves are sized and configured to receive one or more impact mitigation bumpers.

FIGS. 16A through 16E depict another exemplary embodiment of an impact mitigation bumper 1600. In this embodiment, the impact mitigation bumper 1600 may be manufactured in a single unitary piece and/or assembled as a multi-unit piece, and can desirably comprise a first portion 1610, a central region 1620, and/or a second portion 1630. If desired, one or more impact mitigation structures (not shown) can be positioned and/or disposed within some or all of the central region, and/or otherwise between the first and second portions. In this embodiment, the central region 1620 can comprise a C-shaped portion and/or channel 1640 which will desirably accommodate one or more bars of a facemask (not shown). Desirably, at least one of the first or second portions can further comprise a base 1650, the base 1650 allowing at least a portion of the facemask to be positioned onto a helmet structure, with at least a portion of a facemask bar attached to the bumper and at least a portion of the bumper wedged between the facemask and the helmet. As previously noted in connection with other embodiments, the various portions of the bumper may comprise the same material and/or different materials, and at least a portion of any impact mitigation structures positioned therein may comprise filaments, laterally supported filaments, chevron or zigzag structures, inflatable air bladders, auxetic structures, cones, shock absorbers, shock suspension systems, foam layers, and/or any combination.

Figure 10:
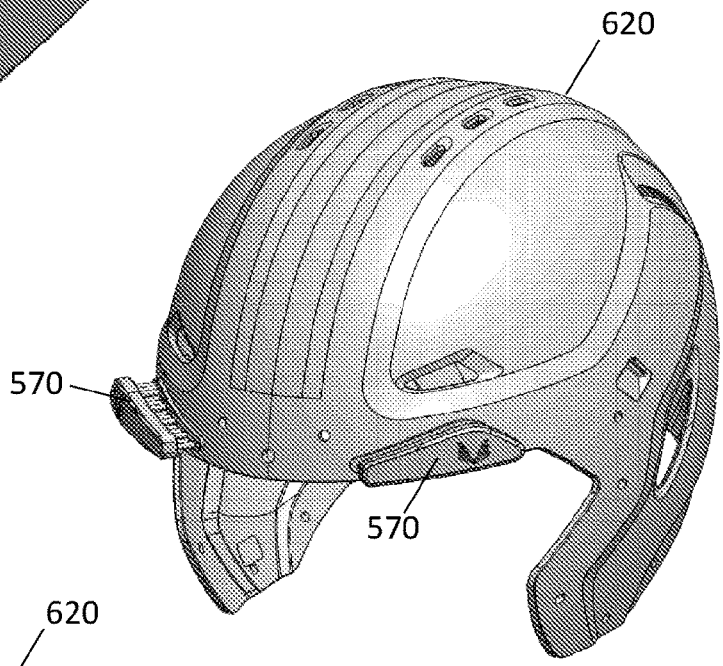
FIG. 10 depicts an isometric view of one embodiment of a helmet with an impact mitigation bumper.
Figure 11:
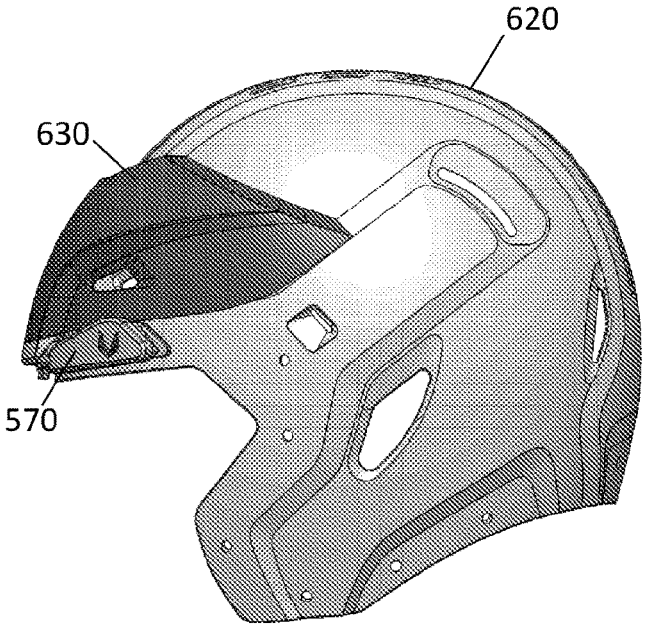
FIG. 11 depicts a side view of one embodiment of helmet with an impact mitigation bumper and a position-specific feature and no facemask.
Figure 12A:
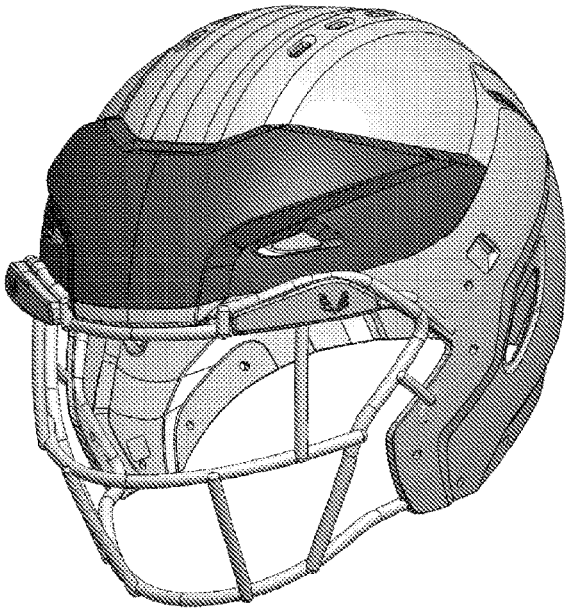
FIGS. 12A-12D depict various views of one embodiment of helmet with an impact mitigation bumper and a position-specific feature with the improved facemask.
Figure 12B:
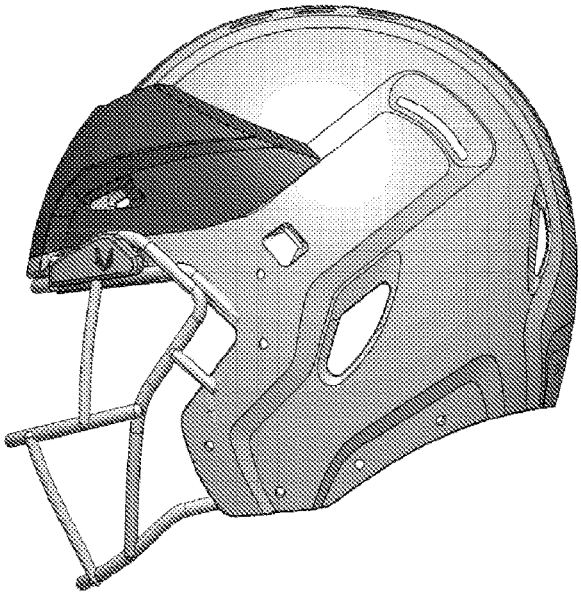
Figure 12C:
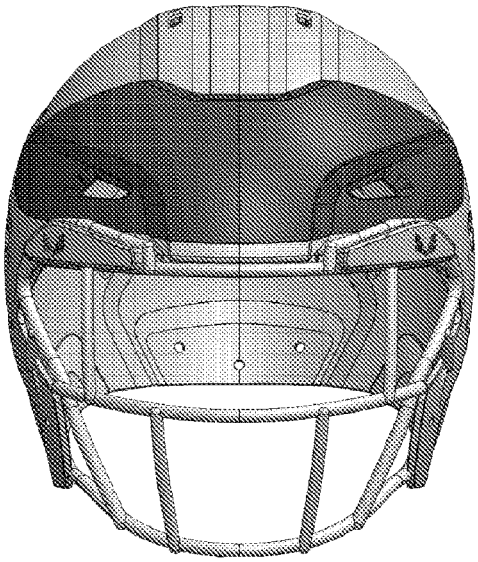
Figure 12D:
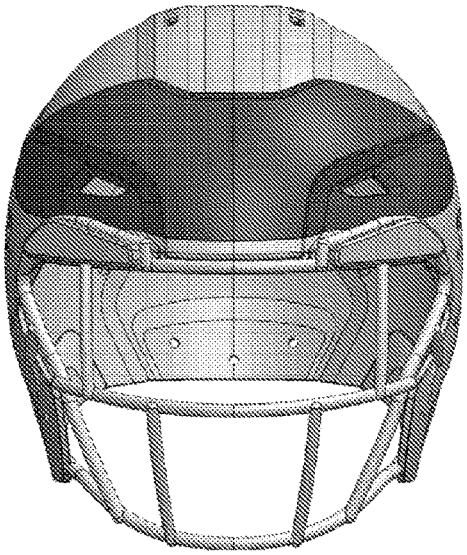

FIGS. 17A through 17F depict another exemplary embodiment of an impact mitigation bumper 1700. In this embodiment, the impact mitigation bumper 1700 may be manufactured in a single unitary piece and/or assembled as a multi-unit piece, and can desirably comprise a first portion 1710, a central region 1720, and/or a second portion 1730. If desired, one or more impact mitigation structures (not shown) can be positioned and/or disposed within some or all of the central region, and/or otherwise between the first and second portions. In this embodiment, the central region 1720 can comprise a U-shaped portion and/or channel 1740 which will desirably accommodate one or more bars of a facemask (not shown). Desirably, at least one of the first or second portions can further comprise a base 1750, the base 1750 allowing at least a portion of the facemask to be positioned onto a helmet structure, with at least a portion of a facemask bar attached to the bumper and at least a portion of the bumper wedged between the facemask and the helmet. As previously noted in connection with other embodiments, the various portions of the bumper may comprise the same material and/or different materials, and at least a portion of any impact mitigation structures positioned therein may comprise filaments, laterally supported filaments, chevron or zigzag structures, inflatable air bladders, auxetic structures, cones, shock absorbers, shock suspension systems, foam layers, and/or any combination In another embodiment, the one or more impact mitigation bumpers may be coupled by pressure exhibited by at least a portion of the facemask and/or other position-specific structures attached externally to the helmet. FIG. 10 illustrates one embodiment of the one or more impact mitigation bumpers 570 being positioned within the first and second arched sections of the helmet 620. The facemask (not shown) will be removably coupled to the helmet, and the least a portion of the helmet will be disposed between the first and second portion of the impact mitigation bumper. The placement of the facemask will not impede the function of the impact mitigation structure disposed between the first and second portion. Subsequently, the facemask will be tightened, and securing the impact mitigation bumper to the helmet. Accordingly, FIG. 11 illustrates another type of pressure fit by a position-specific structure 630 that will be placed over the edge of the first and/or second portion of the impact mitigation bumper 570 allowing the position-specific structure to be tightened, and further securing the impact mitigation bumper to the helmet 620. FIGS. 12A-12C illustrate one embodiment of the pressure fit using a position-specific structure, and at least a portion of the facemask to couple the impact mitigation bumper to the helmet. FIG. 12D depicts using the impact mitigation bumper without a logo present and/or embedded.

Accordingly, FIGS. 12A-12D illustrate another alternate embodiment for a facemask design. The helmet having a front portion and a back portion. The facemask being removably connected to the front portion of the helmet, the facemask having an at least one eye bar, an upper portion and a lower portion. The upper portion including a lower bar, a first arched bar, a second arched bar, the first arched bar and second arched bar is bent upwardly away from a portion of the lower bar creating a distance, the distance being less than a multiple of the diameter of the lower bar, the lower bar extends beyond the first arched bar and/or the second arched bar, the first and/or second arched bar contacts or is coupled to the lower bar. The facemask lower portion includes an upper bar and a lower bar. The upper bar and lower bar are coupled through at least one mandible bar. The least one eye bar being coupled to the upper portion and/or the lower portion.

Figure 13:
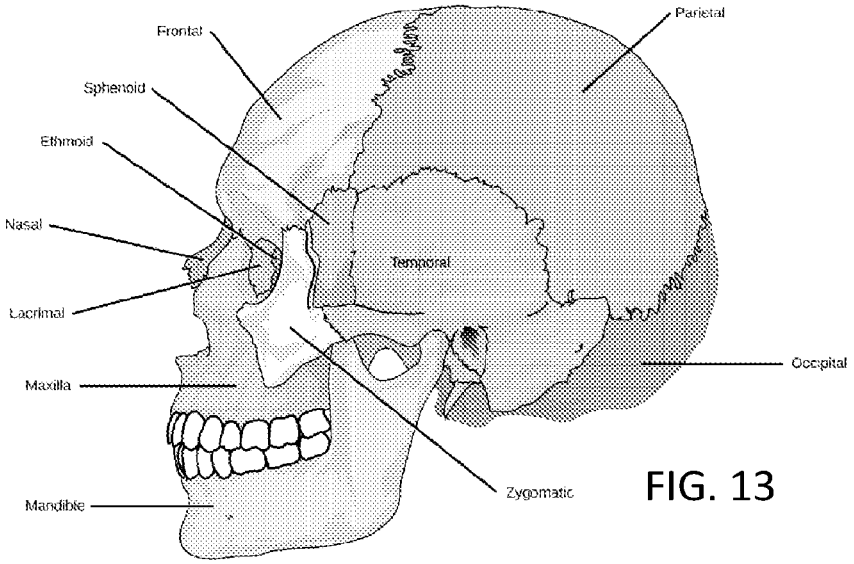
FIG. 13 illustrates one embodiment of the different impact mitigation bumper regions and the different facial bones that may be protected.
Figure 14A:
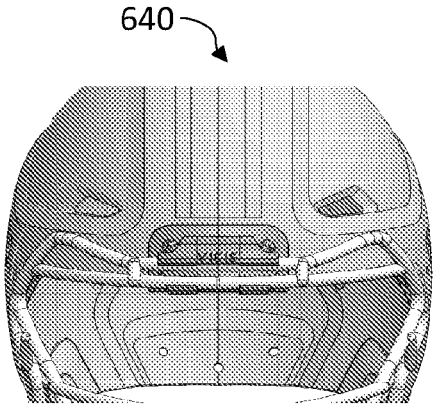
FIGS. 14A-14C illustrates various views of one embodiment of the placement of one or more impact mitigation bumpers on a facemask.
Figure 14B:
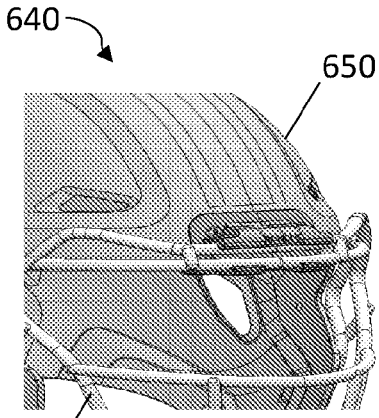
Figure 14C:
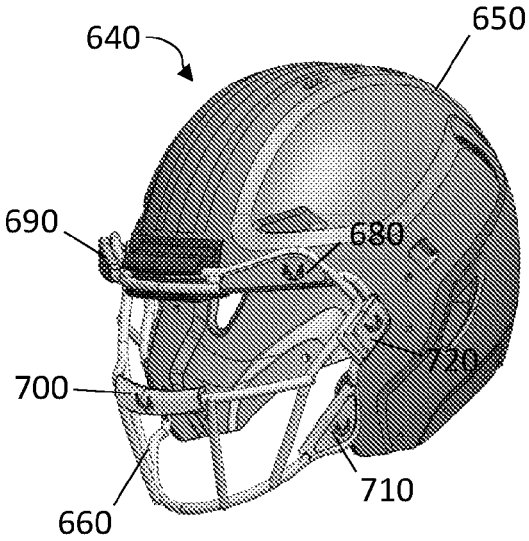

In one embodiment, the new helmet system may comprise the one or more impact mitigation bumpers that are desirably placed in different regions of the facemask. FIG. 13 illustrates one embodiment of a skull highlighting the different bones, which the one or more impact mitigation bumpers may protect. The regions may mimic where the wearers experience the highest facial fractures. The one or more impact mitigation bumpers may be placed within and/or may be placed in proximity to these particular regions of the skull. The different regions may comprise the brow region, the *glabella* region, orbit region, the frontal region, the mandible (front, right and/or left side) region, the maxilla region, the nasal region, zygomatic region, the ethmoid region, the lacrimal region, the sphenoid region and/or any combination thereof. More specifically, FIGS. 14A-14C illustrate the potential placement of one or more impact mitigation bumpers correlating to the different regions. The one or more bumpers may be positioned at the first arched section 680 (frontal region and/or orbital region), a second arched section 690 (frontal region and/or orbital region), the lower portion top bar 700 (nasal region and/or maxilla region), the lower portion bottom bar (not shown) (mandible), right side mandible 710, the left side mandible (not shown), the right cheek 720, the left cheek region (not shown), and/or any combination thereof.

The entire disclosure of each of the publications, patent documents, and other references referred to herein is incorporated herein by reference in its entirety for all purposes to the same extent as if each individual source were individually denoted as being incorporated by reference.

The invention may be embodied in other specific forms without departing from the spirit or essential characteristics thereof. The foregoing embodiments are therefore to be considered in all respects illustrative rather than limiting on the invention described herein. The scope of the invention is thus intended to include all changes that come within the meaning and range of equivalency of the descriptions provided herein.

Many of the aspects and advantages of the present invention may be more clearly understood and appreciated by reference to the accompanying drawings. The accompanying drawings are incorporated herein and form a part of the specification, illustrating embodiments of the present invention and together with the description, disclose the principles of the invention.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the disclosure herein.

What is claimed is:

1. A facemask bumper for a helmet system that includes a helmet and a facemask, the facemask bumper comprising:
- a first portion formed of a first material, wherein the first portion is an outer portion that is offset from the helmet when the facemask bumper is secured to the helmet;
- a second portion formed of a second material, wherein:
  - the second portion is an inner portion that is located at or near the helmet when the facemask bumper is secured to the helmet; and
  - the second portion forms a base of the facemask bumper that is compressed onto the helmet when the facemask is secured to the helmet; and
- a central portion formed of a third material, the central portion disposed between the first portion and the second portion, and the central portion comprising a perimeter and a channel that is shaped, sized, and configured to receive a portion of the facemask, wherein the first portion and the second portion extend beyond the perimeter of the central portion.

2. The facemask bumper of claim 1, wherein the first material, the second material, and the third material comprise the same material.

3. The facemask bumper of claim 2, wherein the same material is a foam material having elastic properties.

4. The facemask bumper of claim 1, wherein the first material, the second material, and the third material are different materials.

5. The facemask bumper of claim 1, wherein the central portion comprises a plurality of impact mitigation structures disposed between the first portion and the second portion.

6. The facemask bumper of claim 5, wherein:
- the plurality of impact mitigation structures create a distance between the first portion and the second portion; and
- the distance accommodates a width or a diameter of the portion of the facemask.

7. The facemask bumper of claim 5, wherein the impact mitigation structures comprise filaments, laterally supported filaments, chevron structures, zigzag structures, inflatable air bladders, auxetic structures, cones, shock absorbers, shock suspension systems, foam layers, or any combination thereof.

8. The facemask bumper of claim 1, wherein durometer of the third material facilitates compression fitting of the facemask bumper onto at least a portion of the facemask.

9. The facemask bumper of claim 1, wherein durometer of the third material facilitates friction of the facemask bumper onto at least a portion of the facemask.

10. A facemask bumper for a helmet system that includes a helmet and a facemask, the facemask bumper comprising:
- an outer portion, wherein the outer portion is offset from the helmet when the facemask bumper is secured to the helmet;
- an inner portion that forms a base of the facemask bumper, wherein the inner portion is located at or near the helmet when the facemask bumper is secured to the helmet; and
- a central portion comprising a perimeter and at least one impact mitigation structure disposed between the outer portion and the inner portion, wherein:
  - the outer portion and the inner portion extend beyond the perimeter of the central portion;
  - the central portion is shaped, sized, and configured to receive a portion of the facemask; and
  - the base is compressed onto the helmet when the facemask is secured to the helmet.

11. The facemask bumper of claim 10, wherein the outer portion, the inner portion, and the central portion comprise a single unitary piece.

12. The facemask bumper of claim 10, wherein:
- the at least one impact mitigation structure creates a distance between the outer portion and the inner portion; and
- the distance accommodates a width or a diameter of the portion of the facemask.

13. The facemask bumper of claim 10, wherein the central portion is formed from a material having a durometer that facilitates compression fitting or friction fitting of the facemask bumper onto at least a portion of the facemask.

14. A facemask bumper for a helmet system that includes a helmet and a facemask, the facemask bumper comprising:
- an outer portion;
- an inner portion that forms a base of the facemask bumper; and
- a central portion comprising a perimeter, the central portion coupled between the outer portion and the inner portion, wherein:
- the outer portion and the inner portion extend beyond the perimeter of the central portion;
- a channel is defined surrounding the perimeter and between opposing sections of the inner and outer portions; and
- the channel is shaped, sized, and configured to receive a portion of the facemask.

15. The facemask bumper of claim 14, wherein:

the outer portion is offset from the helmet when the facemask bumper is secured to the helmet;

the inner portion is located at or near the helmet when the facemask bumper is secured to the helmet; and the base is compressed onto the helmet when the facemask is secured to the helmet.

16. The facemask bumper of claim 14, wherein the outer portion, the inner portion, and the central portion comprise a single unitary piece.

17. The facemask bumper of claim 14, wherein the central portion comprises at least one impact mitigation structure disposed between the outer portion and the inner portion.

18. The facemask bumper of claim 14, wherein the central portion is formed from a material having a durometer that facilitates compression fitting or friction fitting of the facemask bumper onto at least a portion of the facemask.

* * * * *